US011477577B2

(12) United States Patent
Wang et al.

(10) Patent No.: US 11,477,577 B2
(45) Date of Patent: Oct. 18, 2022

(54) SOUNDING DEVICE AND PORTABLE TERMINAL

(71) Applicant: GOERTEK INC., Weifang (CN)

(72) Inventors: Xinglong Wang, Weifang (CN); Lianshan Ge, Weifang (CN); Chunfa Liu, Weifang (CN)

(73) Assignee: GOERTEK INC., Shandong (CN)

( * ) Notice: Subject to any disclaimer, the term of this patent is extended or adjusted under 35 U.S.C. 154(b) by 42 days.

(21) Appl. No.: 17/256,607

(22) PCT Filed: Dec. 14, 2018

(86) PCT No.: PCT/CN2018/121128
§ 371 (c)(1),
(2) Date: Dec. 28, 2020

(87) PCT Pub. No.: WO2020/000925
PCT Pub. Date: Jan. 2, 2020

(65) Prior Publication Data

US 2021/0368272 A1 Nov. 25, 2021

(30) Foreign Application Priority Data

Jun. 25, 2018 (CN) ..... 201810667324.9

(51) Int. Cl.
*H04R 9/02* (2006.01)
*H04R 9/06* (2006.01)

(52) U.S. Cl.
CPC ..... *H04R 9/025* (2013.01); *H04R 9/06* (2013.01); *H04R 2499/11* (2013.01)

(58) Field of Classification Search
CPC . H04R 7/08; H04R 9/025; H04R 7/16; H04R 7/14; H04R 9/06; H04R 7/122; H04R 2499/11
See application file for complete search history.

(56) References Cited

U.S. PATENT DOCUMENTS

2001/0043715 A1 11/2001 Geisenberger et al.
2007/0154057 A1* 7/2007 Takayama ..... H04R 9/045 381/396

(Continued)

FOREIGN PATENT DOCUMENTS

CN 2485745 Y 4/2002
CN 102333270 A 1/2012

(Continued)

OTHER PUBLICATIONS

First Chinese Office Action Application No. 201810667324.9; dated Sep. 20, 2019.

(Continued)

*Primary Examiner* — Alexander Krzystan
*Assistant Examiner* — Julie X Dang

(57) ABSTRACT

A sounding device includes a first vibrating system, a second vibrating system and a magnetic circuit system, where the first vibrating system includes a first vibrating diaphragm and a voice coil arranged inside the first vibrating diaphragm, and the first vibrating diaphragm includes a first central portion; the second vibrating system includes a second vibrating diaphragm disposed opposite to the first vibrating diaphragm, and the second vibrating diaphragm includes a second central portion; and the magnetic circuit system is arranged between the first vibrating diaphragm and the second vibrating diaphragm, and the voice coil is accommodated in a magnetic gap of the magnetic circuit system; the magnetic circuit system defines an avoid hole; and at least one of the first central portion and the second central portion is extended into the avoid hole to fixedly connect the first central portion and the second central portion.

15 Claims, 22 Drawing Sheets

(56) References Cited

U.S. PATENT DOCUMENTS

| | | | | |
|---|---|---|---|---|
| 2011/0211725 | A1* | 9/2011 | Takewa | H04R 9/04 381/412 |
| 2011/0293120 | A1 | 12/2011 | Kolton | |
| 2013/0195293 | A1* | 8/2013 | Ko | H04R 1/24 381/191 |
| 2019/0342668 | A1* | 11/2019 | Tanaka | H04R 7/18 |

FOREIGN PATENT DOCUMENTS

| | | | | |
|---|---|---|---|---|
| CN | 104963112 | A | | 9/2015 |
| CN | 107360524 | A | | 11/2017 |
| CN | 206686369 | U | * | 11/2017 |
| CN | 206686369 | U | | 11/2017 |
| CN | 108632728 | A | | 10/2018 |

OTHER PUBLICATIONS

Second Chinese Office Action Application No. 201810667324.9; dated Feb. 21, 2020.
International Search Report dated Apr. 8, 2019; PCT/CN2018/121128.
Written Opinion dated Apr. 8, 2019; PCT/CN2018/121128.

* cited by examiner

SOUNDING DEVICE AND PORTABLE TERMINAL

TECHNICAL FIELD

The present disclosure relates to the field of electroacoustic technology, in particular to a sounding device and a portable terminal.

BACKGROUND

At present, the loudspeaker has been widely used as an important component of a terminal with audio playback function. Some terminals, especially portable terminals, such as mobile phones, tablet computers, and earphones, can provide very limited installation space for loudspeakers. Therefore, existing loudspeakers that can be applied to a small installation space usually adopt a structure where a single diaphragm produces sound in the front. In order to achieve bidirectional sounding, the prior art provides a loudspeaker using two sets of voice coil and magnetic circuit system. Such loudspeakers are usually large in size and difficult to be widely used.

SUMMARY

The main object of the present disclosure is to provide a sounding device, which aims to solve the technical problem that the existing sounding devices that realize bidirectional sound generation are difficult to be widely used due to their large size.

In order to achieve the above object, the sounding device provided by the present disclosure includes a first vibrating system, a second vibrating system and a magnetic circuit system, where the first vibrating system includes a first vibrating diaphragm and a voice coil arranged inside the first vibrating diaphragm, and the first vibrating diaphragm includes a first central portion;

the second vibrating system includes a second vibrating diaphragm disposed opposite to the first vibrating diaphragm, and the second vibrating diaphragm includes a second central portion; and the magnetic circuit system is arranged between the first vibrating diaphragm and the second vibrating diaphragm, and the voice coil is accommodated in a magnetic gap of the magnetic circuit system; the magnetic circuit system defines an avoid hole; and at least one of the first central portion and the second central portion is extended into the avoid hole to fixedly connect the first central portion and the second central portion.

Preferably, the first central portion includes: a first flat portion and a first reinforcing portion combined with the first flat portion;

the second central portion includes: a second flat portion and a second reinforcing portion combined with the second flat portion;

where at least one of the first central portion and the second central portion is extended into the avoid hole to fixedly connect the first central portion and the second central portion includes:

at least one of the first reinforcing portion and the second reinforcing portion is extended into the avoid hole to fixedly connect the first reinforcing portion and the second reinforcing portion.

Preferably, a first acoustic cavity is defined between the magnetic circuit system and the first vibrating diaphragm, a second acoustic cavity is defined between the magnetic circuit system and the second vibrating diaphragm, and the avoid hole is communicated with the first acoustic cavity and the second acoustic cavity.

Preferably, the first reinforcing portion includes a first protrusion extending into the avoid hole, the second reinforcing portion includes a second protrusion extending into the avoid hole, and the first protrusion and the second protrusion are fixedly connected in the avoid hole.

Preferably, the first protrusion and the second protrusion are fixedly connected in surface contact.

Preferably, the first protrusion and the second protrusion are arranged to be tapered toward each other.

Preferably, a longitudinal cross-sectional shape of a side wall of the first protrusion and/or the second protrusion is stepped, arced or linear.

Preferably, a cross-sectional shape of the first protrusion and/or the second protrusion is rectangular or circular.

Preferably, the magnetic circuit system includes a magnetic yoke and a central magnetic circuit portion and a side magnetic circuit portion provided on the magnetic yoke; and the magnetic gap for accommodating the voice coil is defined between the central magnetic circuit portion and the side magnetic circuit portion; and at least one of the central magnetic circuit portion and the side magnetic circuit portion is provided with a permanent magnet; and a middle portion of the magnetic yoke is cooperated with the central magnetic circuit portion to define the avoid hole.

Preferably, the central magnetic circuit portion includes a central magnetic steel arranged in the middle portion of the magnetic yoke and a central magnetic conductive plate arranged on a top of the central magnetic steel, the magnetic yoke defines a first hole, the central magnetic steel defines a second hole, the central magnetic conductive plate defines a third hole, and the first hole, the second hole and the third hole are communicated to define the avoid hole.

Preferably, an inner wall surface of the first hole and a top surface of the central magnetic steel are enclosed to define a first stepped recess; and/or an inner wall surface of the third hole and a bottom surface of the central magnetic steel are enclosed to define a second stepped recess.

Preferably, the side magnetic circuit portion includes a baffle formed by bending from a periphery of the magnetic yoke; or, the side magnetic circuit portion includes side magnetic steels on a periphery of the central magnetic steel.

Preferably, the magnetic yoke defines an opening in the middle portion, an edge of the opening is bent and extended toward the first vibrating diaphragm to form a flanging, the central magnetic circuit portion is formed by the flanging, and the flanging is enclosed to define the avoid hole; and the side magnetic circuit portion includes side magnetic steels arranged at a periphery of the flanging, and a side magnetic conductive plate arranged at top of the side magnetic steels.

Preferably, a plurality of the flangings are provided, and the plurality of flangings are arranged at intervals along the edge of the opening.

Preferably, the first vibrating diaphragm further includes a first folding ring portion arranged around the first central portion, and a first fixing portion arranged around the first folding ring portion;

the second vibrating diaphragm further includes a second folding ring portion arranged around the second central portion, and a second fixing portion arranged around the second folding ring portion; and the first central portion and the second central portion are both flat sheet structures, and the first folding ring portion and/or the second folding ring portion is a structure formed by a protrusion, or, the first folding ring portion and/or the second folding ring portion is a wave-shaped structure formed by at least one protrusion and at least one recess.

The present disclosure further provides a portable terminal, including a housing defining an accommodating cavity inside, where the portable terminal further includes the sounding device as described above, the sounding device is installed in the accommodating cavity, and the housing defines a first sound hole corresponding to the first vibrating diaphragm and a second sound hole corresponding to the second vibrating diaphragm.

Preferably, the housing includes a front and a back arranged oppositely, the first acoustic hole is defined on the front, and the second acoustic hole is defined on the back.

The structure of the sounding device in the present disclosure is provided with two sets of vibrating systems, but only one set of voice coil and magnetic circuit system is adopted to realize a bidirectional sounding structure, which occupies a small volume, can adapt to a relatively small installation space, and is convenient to be widely used in portable terminals. When the sounding device of the present disclosure works, the first vibrating diaphragm of the first vibrating system is directly driven by the magnetic circuit system. Since an avoid hole is defined between the first acoustic cavity and the second acoustic cavity to communicate the two, and at least one of the first central portion and the second central portion is extended into the avoid hole to be fixedly connected, the second vibrating diaphragm of the second vibrating system vibrates and sounds synchronously, that is, the first vibrating diaphragm and the second vibrating diaphragm are linked for sounding. When applied to a portable terminal, the sounding device of the present disclosure can respectively emit sound in the front and back directions of the portable terminal through the first vibrating system and the second vibrating system.

BRIEF DESCRIPTION OF THE DRAWINGS

In order to more clearly explain the embodiments of the present disclosure or the technical solutions in the prior art, the drawings used in the description of the embodiments or the prior art will be briefly introduced below. Obviously, the drawings in the following description are merely some embodiments of the present disclosure. For those of ordinary skill in the art, other drawings can be obtained based on the structure shown in these drawings without paying creative work.

DESCRIPTION OF REFERENCE NUMERALS

Figure 1:
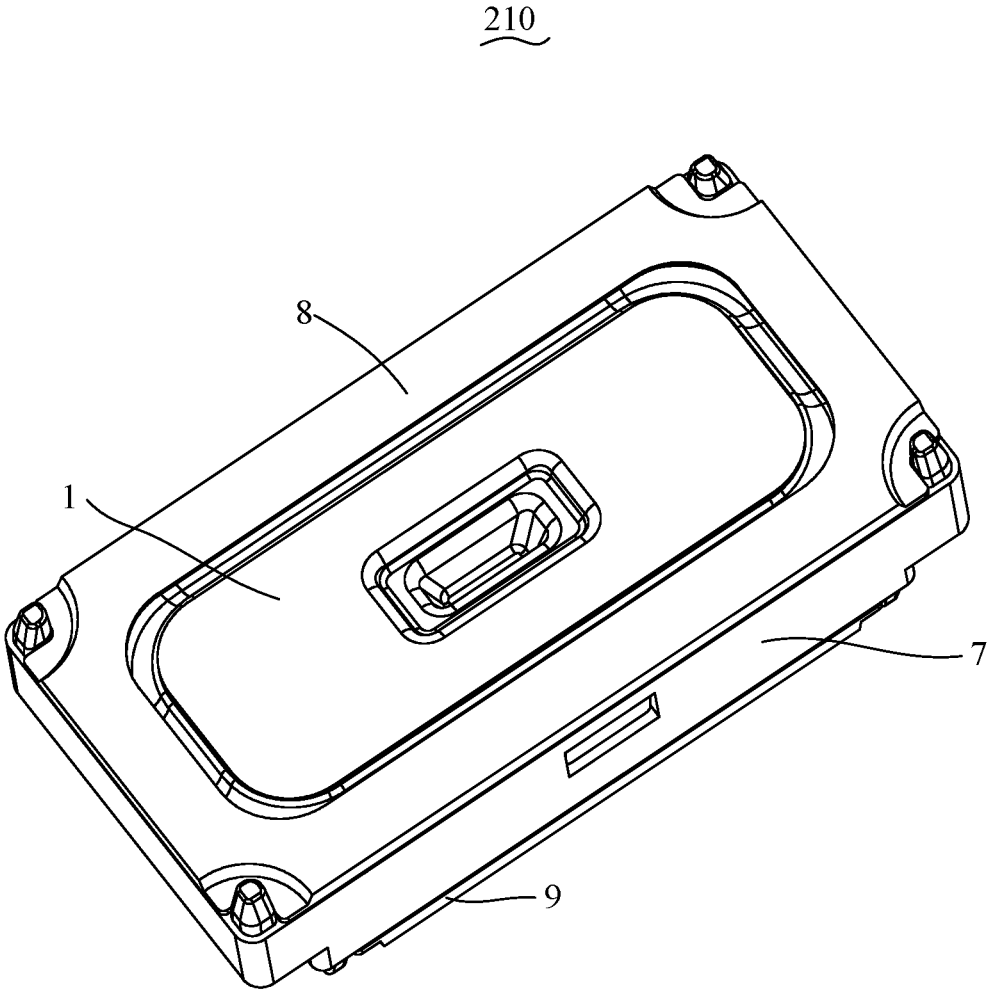
FIG. 1 is a schematic diagram of a front structure of a sounding device according to an embodiment of the present disclosure.
Figure 2:
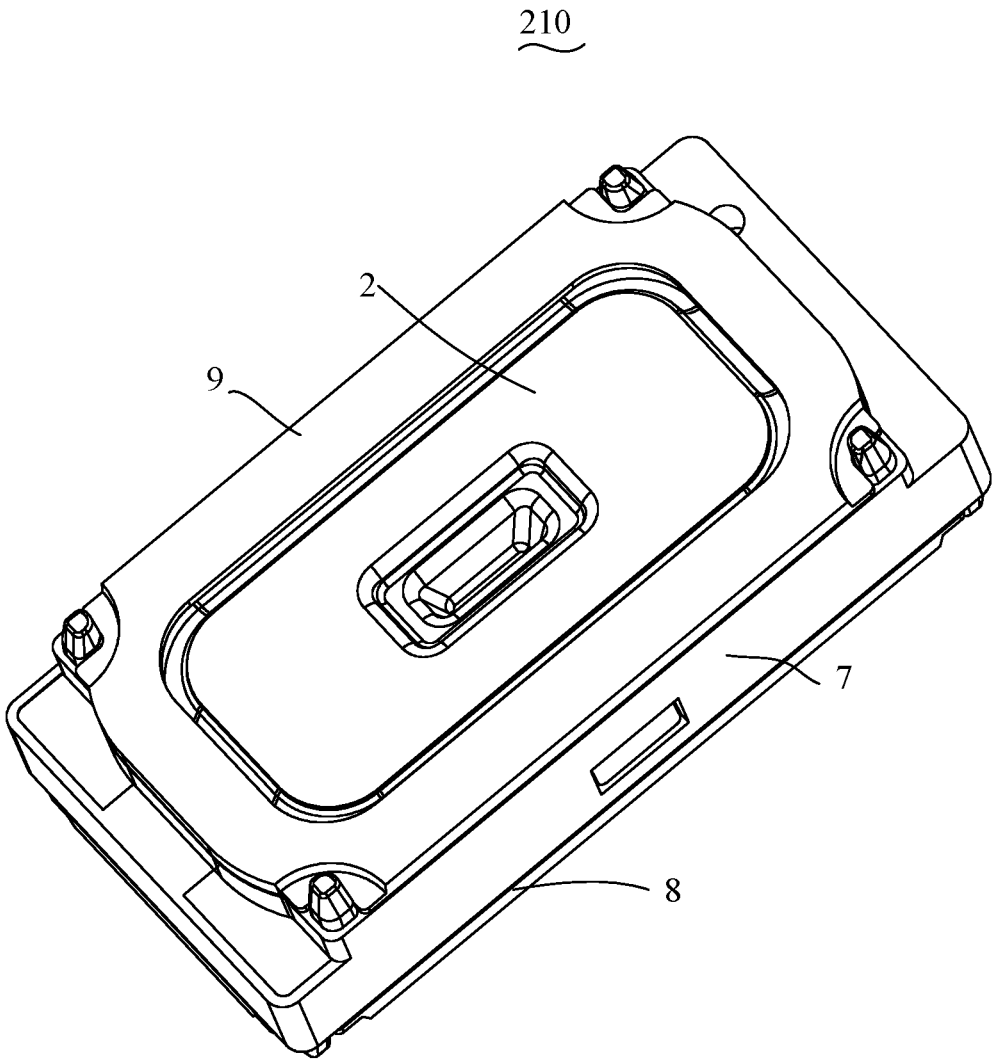
FIG. 2 is a schematic diagram of a back structure of the sounding device in FIG. 1.

1: first vibrating system; 11: first vibrating diaphragm; 111: first central portion; 111*a*: first flat portion; 112, 113, 114: first reinforcing portion; 113*a*, 113*b*, 113*c*, 113*d*, 113*e*: first protrusion; 115: first folding ring portion; 117: first fixing portion; 12: voice coil;

2: second vibrating system; 21*a*, 21*b*: second vibrating diaphragm; 211: second central portion; 211*a*: second flat portion; 212*a*, 212*b*: second folding ring portion; 213: second fixing portion; 214, 215, 216: second reinforcing portion; 214*a*, 214*b*, 214*c*, 214*d*, 214*e*: second protrusion;

3*a*, 3*b*: magnetic circuit system; 31: magnetic gap; 32*a*, 32*b*: avoid hole; 32*c*: side through hole; 33: air flow passage; 34*a*, 34*b*: magnetic yoke; 341: first hole; 341*a*: first stepped recess; 343: baffle; 341*b*: opening; 343*b*, 343*c*: flanging; 35*a*, 35*b*: central magnetic steel; 351*a*, 351*b*, 351*c*, 351*d*: second hole; 352*b*, 352*c*: sub-magnetic steel; 352*d*: slit; 36: central magnetic conductive plate; 361: third hole; 361*a*: second stepped recess; 37: side magnetic steel; 38, 38*a*: side magnetic conductive plate;

5: first acoustic cavity; 6: second acoustic cavity; 7: housing; 8: front cover; 9: rear cover; 100: portable terminal; 110: housing; 130: first acoustic hole; 140: second acoustic hole; 210: sounding device;

The realization of the objects, functional characteristics and advantages of this disclosure will be further described in conjunction with the embodiments and with reference to the drawings.

DETAILED DESCRIPTION OF THE EMBODIMENTS

In the following, the technical solutions in the embodiments of the present disclosure will be clearly and completely described with reference to the drawings in the embodiments of the present disclosure. Obviously, the described embodiments are only a part of the embodiments of the present disclosure, but not all of the embodiments. Based on the embodiments of the present disclosure, all other embodiments obtained by those of ordinary skill in the art without creative efforts shall fall within the protection scope of the present disclosure.

It should be noted that all directional indicators (such as up, down, left, right, front, back, etc.) in the embodiments of the present disclosure are only used to explain the relative positional relationship, movement situation, etc. between components in a specific posture (as shown in the drawings). If the specific posture changes, the directional indication also changes accordingly.

In addition, if there are descriptions involving "first", "second", etc. in the embodiments of the present disclosure, the descriptions of "first", "second", etc. are only used for descriptive purposes, and cannot be understood as instructions or implications of its relative importance or implicitly indicates the number of technical features indicated. Therefore, the features defined with "first" and "second" may explicitly or implicitly include at least one of the features. In addition, the technical solutions between the various embodiments can be combined with each other, but they must be based on what can be achieved by those of ordinary skill in the art. When the combination of technical solutions is contradictory or cannot be achieved, it should be considered that such a combination of technical solutions does not exist, nor within the protection scope of the present disclosure.

The present disclosure provides a sounding device 210.

Referring to FIGS. 1 to 5, in the embodiments of the present disclosure, the sounding device 210 includes a first vibrating system 1, a second vibrating system 2 and a magnetic circuit system 3*a*, where the first vibrating system 1 includes a first vibrating diaphragm 11 and a voice coil 12 arranged inside the first vibrating diaphragm 11, and the first vibrating diaphragm 11 includes a first central portion 111;

the second vibrating system 2 includes a second vibrating diaphragm 21*a* disposed opposite to the first vibrating diaphragm 11, and the second vibrating diaphragm 21*a* includes a second central portion 211; and the magnetic circuit system 3*a* is arranged between the first vibrating diaphragm 11 and the second vibrating diaphragm 21*a*, and the voice coil 12 is accommodated in a magnetic gap 31 of the magnetic circuit system 3*a*; the magnetic circuit system 3*a* defines an avoid hole 32*a*; and at least one of the first central portion 111 and the second central portion 211 is extended into the avoid hole 32*a* to fixedly connect the first central portion 111 and the second central portion 211.

In this embodiment, in order to simplify the description, a position when the first vibrating diaphragm 11 of the sounding device 210 is placed upward is taken as a reference to define upper and lower positions, that is, a side of the first vibrating diaphragm 11 facing away from the magnetic circuit system 3*a* is an upper side, and a side of the first vibrating diaphragm 11 facing the magnetic circuit system 3*a* is an lower side.

The first vibrating system 1 can refer to the existing structure. Specifically, the voice coil 12 is fixedly connected to the first vibrating diaphragm 11 and extends into the magnetic gap 31. The changing current of the voice coil 12 is vibrated by different ampere forces, and the voice coil 12 vibrates to drive the first vibrating diaphragm 11 to vibrate, and its energy conversion manner is electrical energy-mechanical energy-sound energy. In order to adjust the frequency characteristics of the vibration, the first vibrating system 1 may further include a counterweight (not shown). The magnetic circuit system 3*a* can also refer to the existing structure, and a shape of the central magnetic steel 35*a* in plan view may be circular or rectangular with rounded corners.

In order to facilitate the installation of the first vibrating system 1, the second vibrating system 2 and the magnetic circuit system 3*a* between the two, the sounding device 210 further includes a housing 7, a front cover 8 and a rear cover 9. The housing 7 is configured to house the first vibrating system 1, the second vibrating system 2 and magnetic circuit system 3*a*. The front cover 8 and the rear cover 9 cooperate with the housing 7 to form a protective frame. Specifically, an edge of the first vibrating diaphragm 11 for fixing is clamped by the front cover 8 and the housing 7, and an edge of the second vibrating diaphragm 21*a* for fixing is clamped by the rear cover 9 and the housing 7. The front cover 8 is provided corresponding to the first vibrating system 1 and defines a front sound outlet for sound emission, and the rear cover 9 is provided corresponding to the second vibrating system 2 and defines a rear sound hole for sound emission.

In this way, in the present disclosure, at least one of the first central portion 111 of the first vibrating diaphragm 11 and the second central portion 211 of the second vibrating diaphragm 21*a* in the sounding device 210 is inserted into the avoid hole 32*a*, and the first central portion 111 and the second central portion 211 are fixedly connected. Since the sounding device 210 includes the magnetic circuit system 3*a* and the voice coil 12, and the voice coil 12 is connected to the first vibrating diaphragm 11, after the current is applied to the voice coil 12, the voice coil 12 vibrates due to the ampere force, so as to push the first vibrating diaphragm 11 to vibrate. Since the first central portion 111 of the first vibrating diaphragm 11 is fixedly connected to the second central portion 211 of the second vibrating diaphragm 21*a*, when the first vibrating diaphragm 11 vibrates, its first central portion 111 will drive the second central portion 211 of the second vibrating diaphragm 21*a* to vibrate, thereby driving the second vibrating diaphragm 21*a* to vibrate, which can make the second vibrating diaphragm 21*a* instigate air to produce sound to achieve bidirectional sounding. That is, the structure of the sounding device 210 in the present disclosure is provided with two sets of vibrating systems, but only one set of voice coil 12 and magnetic circuit system 3 is adopted to realize a bidirectional sounding structure, which occupies a small volume, can adapt to a relatively small installation space, and is convenient to be widely used in portable terminals 100. At the same time, in this structure, only the first vibrating diaphragm 11 and the second vibrating diaphragm 21*a* can be connected by themselves, and additional connecting parts are omitted, so that the cost of the sounding device 210 can be reduced.

Further, the first central portion 211 includes a first flat portion 111*a* and a first reinforcing portion 113 combined with the first flat portion 111*a*.

The second central portion includes: a second flat portion 211*a* and a second reinforcing portion 214 combined with the second flat portion 211*a*.

At this time, at least one of the first central portion 111 and the second central portion 211 is extended into the avoid hole 32*a* to fixedly connect the first central portion 111 and the second central portion 211 includes:

at least one of the first reinforcing portion 113 and the second reinforcing portion 214 is extended into the avoid hole 32*a* to fixedly connect the first reinforcing portion 113 and the second reinforcing portion 214.

The provision of the first reinforcing portion 113 and the second reinforcing portion 214 can increase the hardness of the first vibrating diaphragm 11 and the second vibrating diaphragm 21*a*, and ensure the high frequency performance of the first vibrating diaphragm 11 and the second vibrating diaphragm 21*a*. The fixed connection between the first reinforcing portion 113 and the second reinforcing portion 214 may be glue bonding or integral injection molding connection. At least one of the first reinforcing portion 113 and the second reinforcing portion 214 is extended into the avoid hole 32*a* to be connected to each other, so at least one of the first reinforcing portion 113 and the second reinforcing portion 214 includes a dome shaped structure. In addition, an air flow passage 33 for communicating the first acoustic cavity 5 and the second acoustic cavity 6 is defined between the first reinforcing portion and the inner wall surface of the avoid hole 32*a*, and the second reinforcing portion 214 and the inner wall surface of the avoid hole 32*a*, respectively. In order to ensure better sound performance of the passively radiated second vibrating diaphragm 21*a*, materials of the first reinforcing portion 113 and the second reinforcing portion 214 include but are not limited to a plastic material such as Kapton (polyimide (PI) film material), polyethylene naphthalate (PEN), polyimide (PI), Liquid Crystal Polymer (LCP), polycarbonate (PC), Polyphthalamide (PPA), and a metal material such as aluminum foil/magnesium-aluminum alloy/magnesium-lithium alloy. The processing methods of the first reinforcing portion 113 and the second reinforcing portion 214 include but are not limited to: blow molding, injection molding, stamping, and hot pressing.

It should be noted that, in the embodiments of the present disclosure, the first reinforcing portion 113 and the second reinforcing portion 214 may be a single-layer structure or a multilayer composite structure, which is not limited in the present disclosure.

When the sounding device 210 of the present disclosure is working, the first vibrating diaphragm 11 of the first vibrating system 1 is directly driven by the magnetic circuit system 3*a*. Since an avoid hole 32*a* is defined between the first acoustic cavity 5 and the second acoustic cavity 6 to communicate the two, and at least one of the first reinforcing portion 113 and the second reinforcing portion 214 is extended into the avoid hole 32*a* to be fixedly connected, when the first vibrating diaphragm 11 vibrates and emits sound, the first reinforcing portion 113 drives the second reinforcing portion 214 to vibrate, so that the second vibrating diaphragm 21*a* vibrates, that is, when the first vibrating diaphragm 11 of the first vibrating system 1 vibrates and sounds, the second vibrating diaphragm 21*a* of the second vibrating system 2 vibrates and sounds synchronously, that is, the first vibrating diaphragm 11 and the second vibrating diaphragm 21*a* are linked for sounding.

Further, a first acoustic cavity 5 is defined between the magnetic circuit system 3*a* and the first vibrating diaphragm 11, a second acoustic cavity 6 is defined between the magnetic circuit system 3*a* and the second vibrating diaphragm 21, and the avoid hole 32*a* is communicated with the first acoustic cavity 5 and the second acoustic cavity 6. In this way, while the first vibrating diaphragm 11 and the second vibrating diaphragm 21*a* make are linked for sounding, since the air in the first acoustic cavity 5 and the second acoustic cavity 6 can circulate through the avoid hole 32*a*, the air pressure difference between the two is small, the resistance caused by the vibration of the first vibrating diaphragm 11 and the second vibrating diaphragm 21 is also relatively small, so that better acoustic performance can be achieved. When applied to a portable terminal 100, the sounding device 210 of the present disclosure can respectively emit sound in the front and back directions of the portable terminal 100 through the first vibrating system 1 and the second vibrating system 2.

Figure 3:
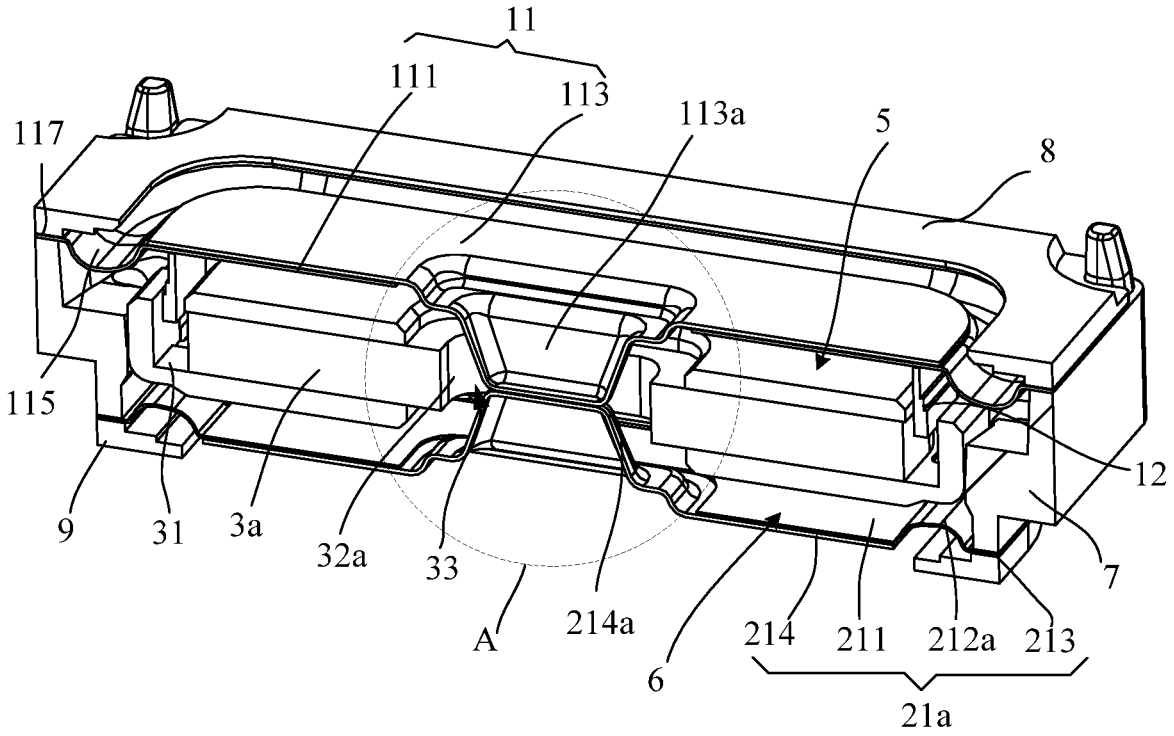
FIG. 3 is a schematic cross-sectional structure diagram of the sounding device in FIG. 1, which illustrates a magnetic circuit system, a first vibrating diaphragm and a second vibrating diaphragm according to a first embodiment.
Figure 4:
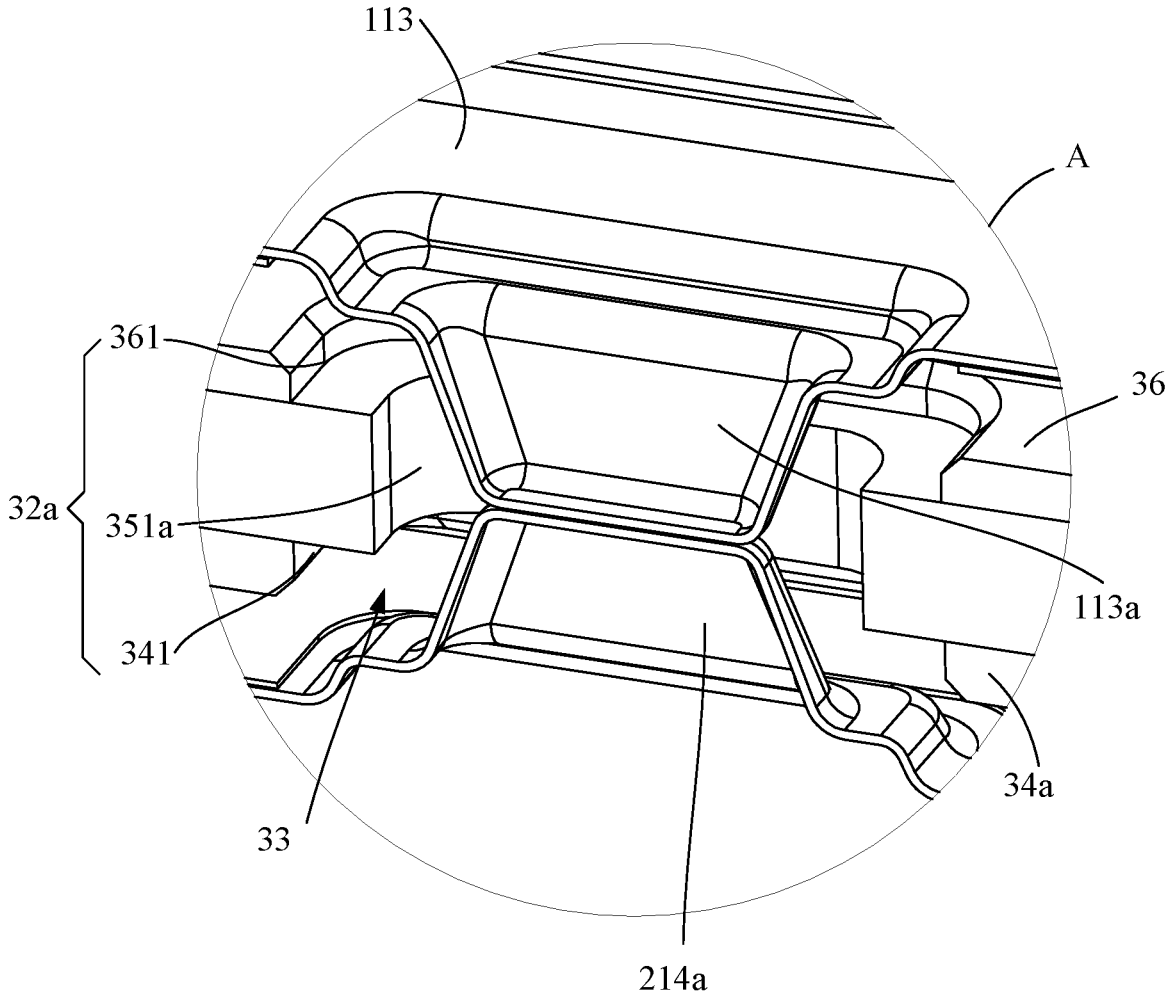
FIG. 4 is a partial enlarged view of A in FIG. 3.
Figure 5:
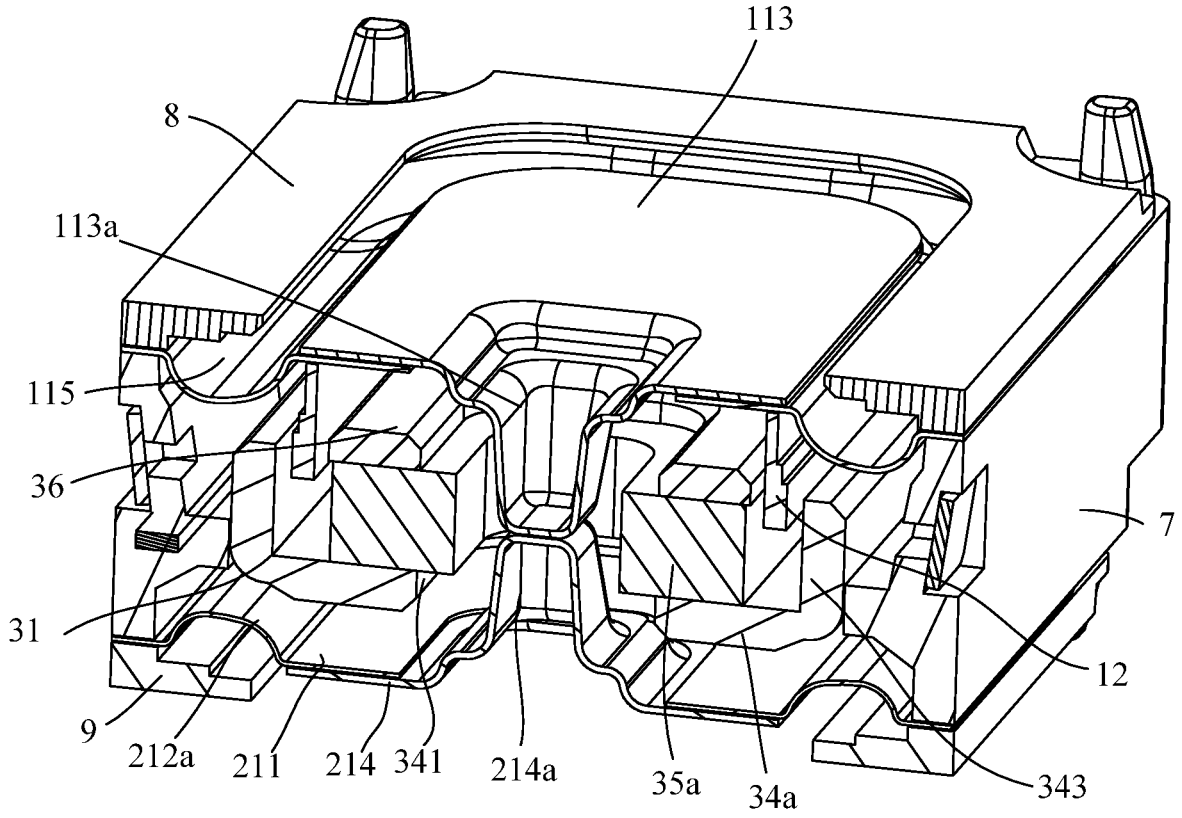
FIG. 5 is another schematic cross-sectional structure diagram of the sounding device in FIG. 1.
Figure 6:
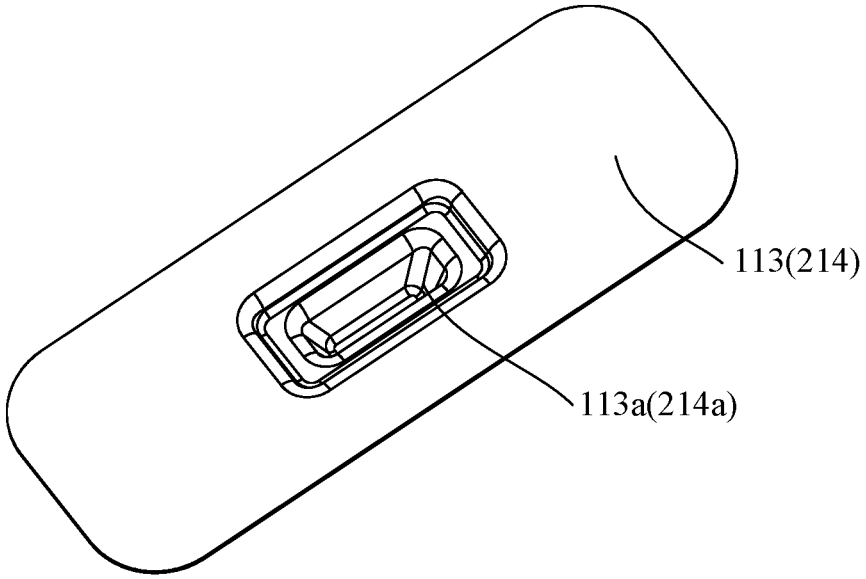
FIG. 6 is a schematic structural diagram of a first reinforcing portion and a second reinforcing portion in the sounding device shown in FIG. 3 according to the first embodiment.
Figure 7:
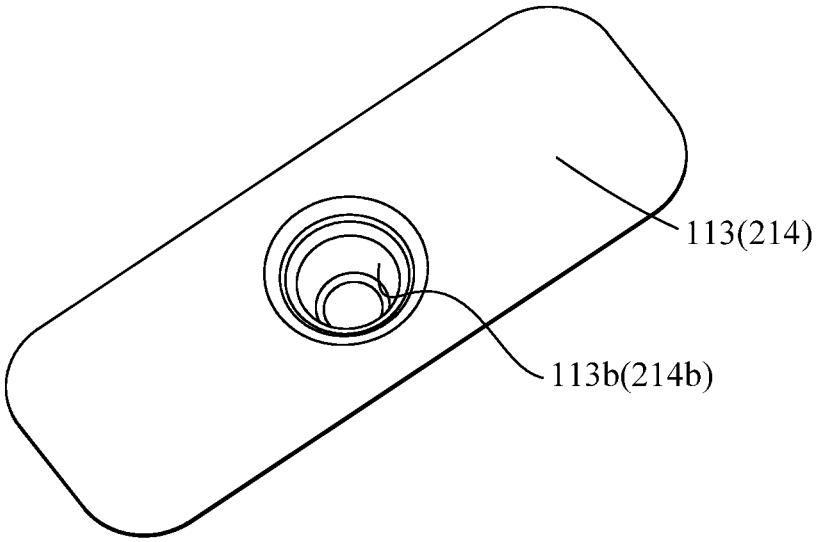
FIG. 7 is a schematic structural diagram of the first reinforcing portion and the second reinforcing portion shown in FIG. 6 according to a second embodiment.
Figure 8:
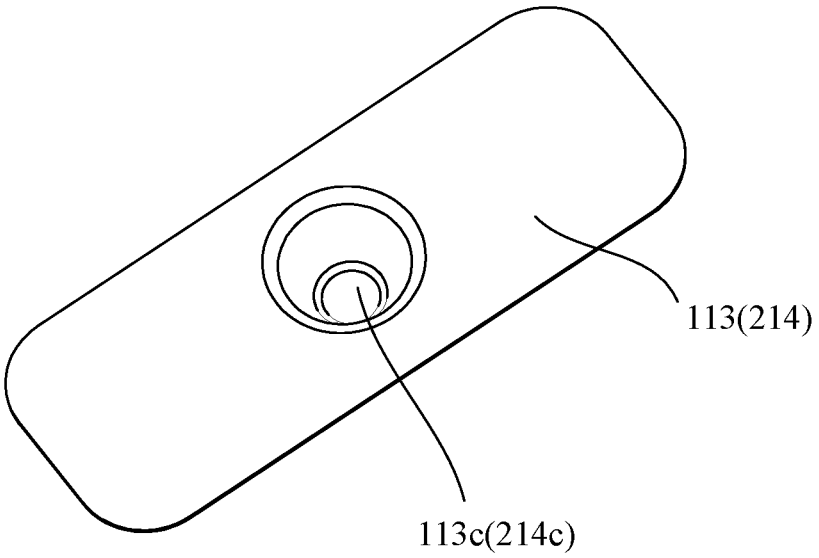
FIG. 8 is a schematic structural diagram of the first reinforcing portion and the second reinforcing portion shown in FIG. 6 according to a third embodiment.
Figure 9:
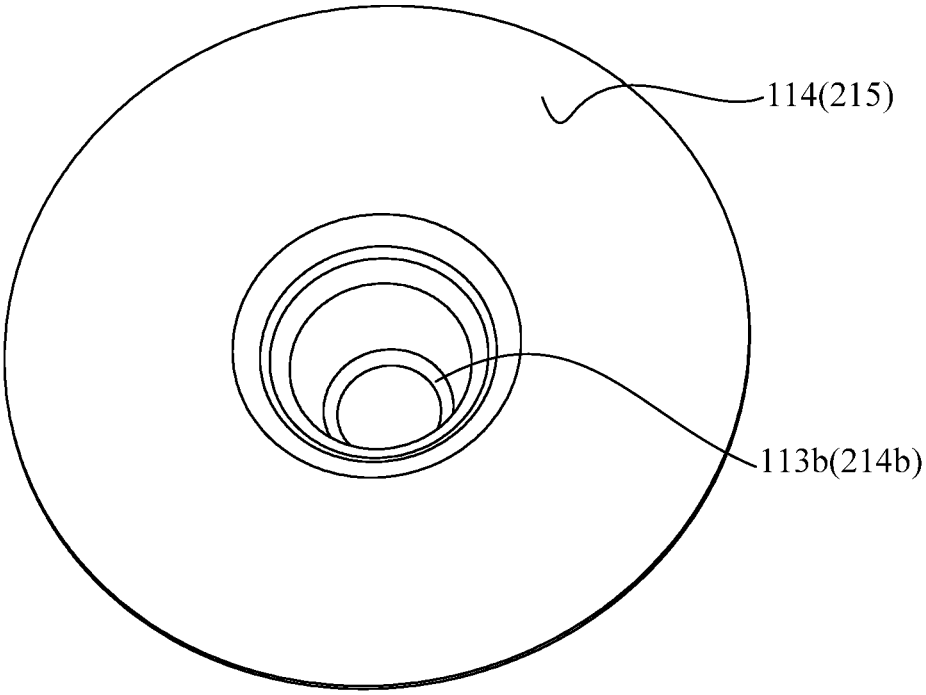
FIG. 9 is a schematic structural diagram of the first reinforcing portion and the second reinforcing portion shown in FIG. 6 according to a fourth embodiment.
Figure 10:
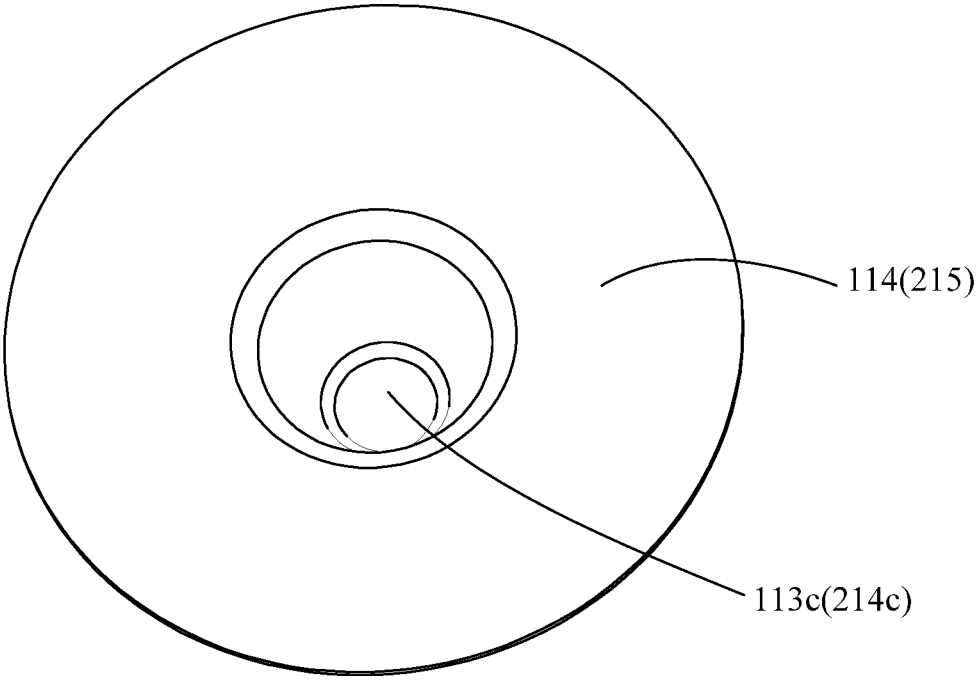
FIG. 10 is a schematic structural diagram of the first reinforcing portion and the second reinforcing portion shown in FIG. 6 according to a fifth embodiment.
Figure 11:
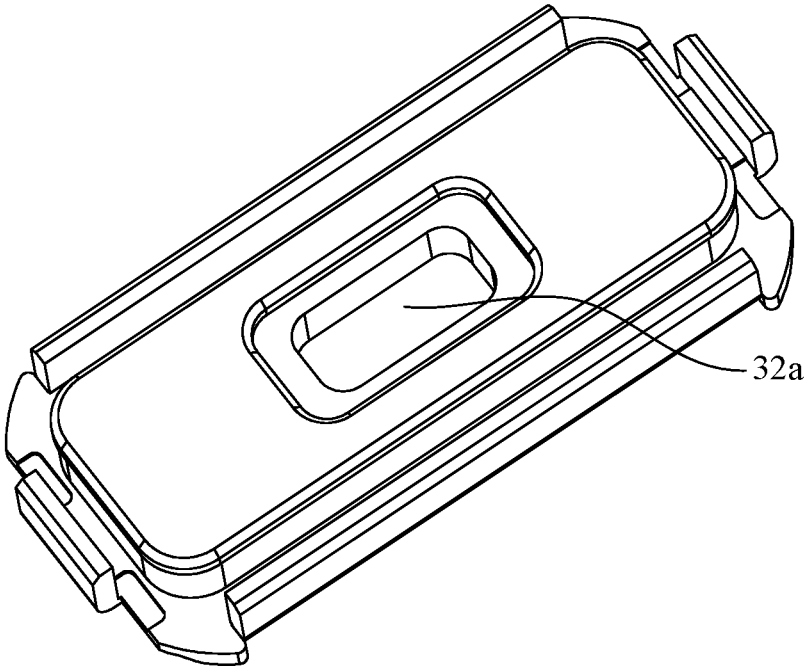
FIG. 11 is a schematic structural diagram of a magnetic circuit system of the sounding device in FIG. 3 according to an embodiment.

Please refer to FIGS. 3 to 5 in combination. In order to facilitate batch processing, the first reinforcing portion 113 of the first vibrating diaphragm 11 and the second reinforcing portion 214 of the second vibrating diaphragm 21*a* are both provided with a portion extending into the avoid hole 32*a*. The first reinforcing portion 113 includes a first protrusion 113*a* extending into the avoid hole 32*a*, the second reinforcing portion 214 includes a second protrusion 214*a* extending into the avoid hole 32*a*, and the first protrusion 113*a* and the second protrusion 214*a* are fixedly connected in the avoid hole 32*a*.

In this embodiment, the first protrusion 113*a* is formed by directly protruding from the first reinforcing portion 113, and the interior of the first protrusion 113*a* is hollow. This structure can not only ensure the structural strength during transmission, but also reduce energy loss by reducing mass, so that the vibration transmitted by the first protrusion 113*a* can be more significant, and the high frequency performance of the sounding device can be improved. The second protrusion 214*a* has the same structure as the first protrusion 113*a*, which facilitates processing and improves production efficiency.

Please refer to FIGS. 6 to 10 in combination, in different embodiments, the first reinforcing portion 113 and the second reinforcing portion 214 are rectangular in shape, or, the first reinforcing portion 114 and the second reinforcing portion 215 are circular in shape. Meanwhile, the cross-sectional shapes of the first protrusion 113*a* and the second protrusion 214*a* are rectangular, or the cross-sectional shapes of the first protrusion (113*b*, 113*c*) and the second protrusion (214*b*, 214*c*) are circular, or the above two shapes can be combined arbitrarily.

Please refer to FIGS. 11 to 14. Correspondingly, the cross-sectional shape of the avoid hole 32*a* also includes circular and rectangular embodiments, which can be matched with the first protrusion 113*a* and the second protrusion 214*a*, so that the first protrusion 113*a* and the second protrusion 214*a* can be better accommodated therein to facilitate the fixed connection.

When the cross-sectional shapes of the first protrusion (113*b*, 113*c*) and the second protrusion (214*b*, 214*c*) are both circular, the cross-sectional shape of the avoid hole 32*a* is circular; when the cross-sectional shapes of the first protrusion 113*a* and the second protrusion 113*a* are both rectangular, the cross-sectional shape of the avoid hole 32*a* is also rectangular, and the rectangles here are all rounded rectangles, so that the airflow in the avoid hole 32*a* flows more smoothly, and there are no sharp parts, which improves the roundness of the sound of the sounding device 210 and the comfort of the user.

Please continue to refer to FIGS. 4 and 5, the first protrusion 113*a* and the second protrusion 214*a* are fixedly connected in surface contact.

In this embodiment, the first protrusion 113*a* and the second protrusion 214*a* are respectively provided in the middle portion of the first reinforcing portion 113 and the middle portion of the second reinforcing portion 214. A periphery of the first reinforcing portion 113 is connected to the first flat portion 111*a*, and a periphery of the second reinforcing portion 214 is connected to the second flat portion 211*a*. Specifically, the first flat portion 111*a* and the second flat portion 211*a* are both flat sheet structures, a reinforcing hole (not marked) is defined in the middle of the two, and the peripheries of the first reinforcing portion 113 and the second reinforcing portion 214 are overlapped and combined with a peripheral edge of the avoid hole to increase the overall strength of each of the first vibrating diaphragm 11 and the second vibrating diaphragm 21*a*.

In order to increase the connection strength between the first vibrating diaphragm 11 and the second vibrating diaphragm 21*a*, the first protrusion 113*a* and the second protrusion 214*a* are fixedly connected in surface contact, that is, a bottom wall of the first protrusion 113*a* is connected to a bottom surface of the second protrusion 214*a*, and the bottom wall of the first protrusion 113*a* and the bottom wall of the second protrusion 214*a* have certain area requirements. The larger the area, the greater the adhesive force. The same applies to integral injection molding or welding. At this time, the longitudinal cross-sectional shapes of the first protrusion 113*a* and the second protrusion 214*a* are set to a standard U-shape, an expanded U-shape or a similar U-shape, and only a flat bottom wall is required to ensure the firmness of later bonding.

At the same time, in order to further enhance the structural strength of the first reinforcing portion 113 and the second reinforcing portion 214 and reduce the mass of the first reinforcing portion 113 and the second reinforcing portion 214, the first protrusion 113*a* and the second protrusion 214*a* are arranged to be tapered toward each other, that is, the cross-sectional area of the first protrusion 113*a* gradually decreases in the direction of the second vibrating diaphragm 21*a*, and the cross-sectional area of the second protrusion 214*a* gradually decreases in the direction of the first vibrating diaphragm 11. Such arrangement of this structure can increase the structural strength of the first reinforcing portion 113 and the second reinforcing portion 214, and can increase the connection strength between the first protrusion 113*a* and the second protrusion 214*a*, so as to ensure the driving force of the second vibrating diaphragm 21*a*. In addition, the tapered first protrusion 113*a* and the second protrusion 214*a* can also indirectly widen the air flow passage 33, thereby increasing the effective flow area, and thus can further promote the air connectivity between the first acoustic cavity 5 and the second acoustic cavity 6.

Certainly, one of the first protrusion 113*a* and the second protrusion 214*a* may be tapered in the other direction, or neither of them may be tapered, which is not limited here.

On the basis of the foregoing embodiments, a longitudinal cross-sectional shape of a side wall of the first protrusion 113*a* and/or the second protrusion 214*a* is stepped, arced or linear.

Figure 15:
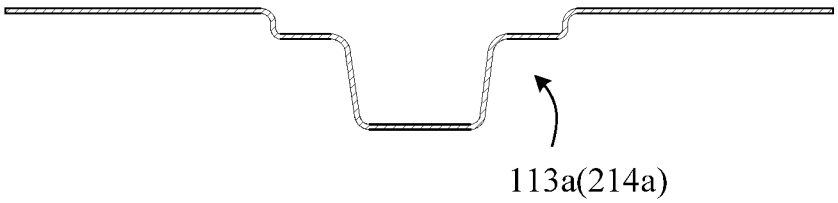
FIG. 15 is a cross-sectional view of the first reinforcing portion and the second reinforcing portion shown in FIG. 6.

Please refer to FIG. 15, in the first embodiment of the sidewalls of the first protrusion 113*a* and the second protrusion 214*a*, the longitudinal cross-sectional shapes are stepped, that is, the sidewalls of the first protrusion 113*a* and the second protrusion 214*a* are multi-stage bending arrangement, this structure can further improve the strength of the first protrusion 113*a* and the second protrusion 214*a*, and at the same time increase the connection strength of the first reinforcing portion 113 and the second reinforcing portion 214, so as to obtain better sound effect.

Figure 16:
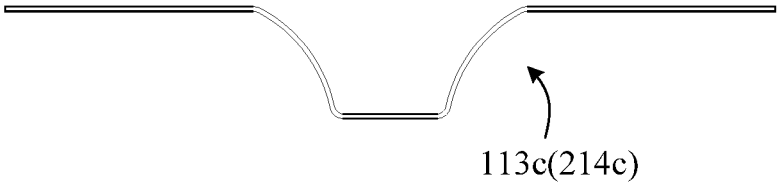
FIG. 16 is a cross-sectional view of the first reinforcing portion and the second reinforcing portion shown in FIG. 10.
Figure 17:
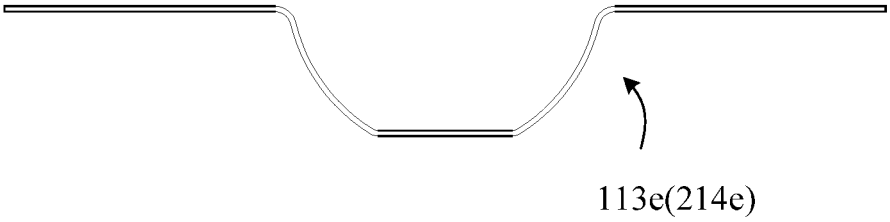
FIG. 17 is a cross-sectional view of the first reinforcing portion and the second reinforcing portion shown in FIG. 15 according to another embodiment.

In the second embodiment, referring to FIGS. 16 and 17, the longitudinal cross-sectional shape of the sidewalls of the first protrusion (113*c*, 113*e*) and/or the second protrusion (214*c*, 214*e*) is arced. In this embodiment, the arc-shaped side wall can bulge in the direction of the avoid hole 32*a*, or it can be recessed in the direction away from the avoid hole 32*a*. In both cases, the first protrusion (113*c*, 113*e*) and the second protrusion (214*c*, 214*e*) have higher structural strength, so as to obtain better connection strength.

Figure 18:
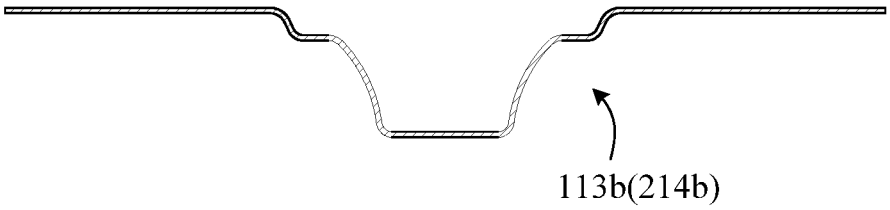
FIG. 18 is a cross-sectional view of the first reinforcing portion and the second reinforcing portion shown in FIG. 15 according to still another embodiment.
Figure 19:
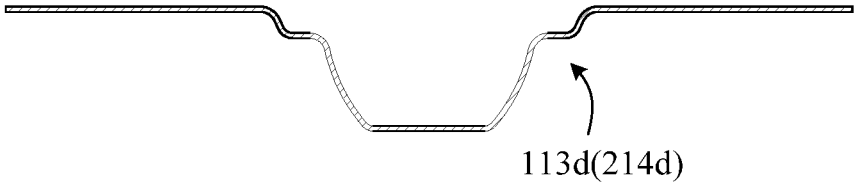
FIG. 19 is a cross-sectional view of the first reinforcing portion and the second reinforcing portion shown in FIG. 15 according to a further embodiment.
Figure 20:
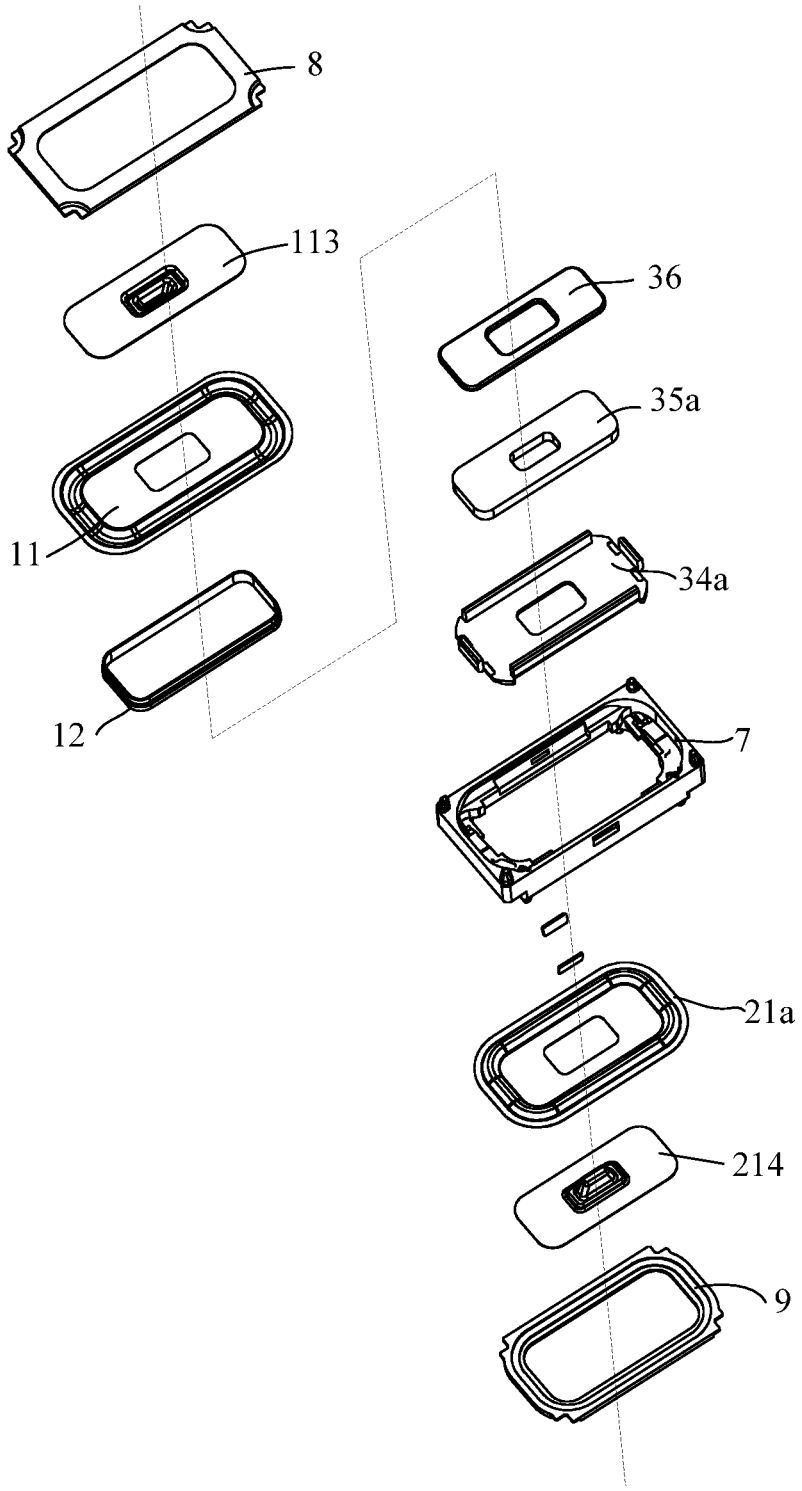
FIG. 20 is an exploded view of the sounding device shown in FIG. 1.

In addition, the second embodiment can also be combined with the stepped configuration in the first embodiment. This structure is the third embodiment. Refer to FIGS. 18 and 19 for the specific structure. The first protrusion (113*b*, 113*d*) and the second protrusion (214*b*, 214*d*) combine the advantages of the two, which can further obtain higher structural strength, and ensure the connection stability between the first vibrating diaphragm 11 and the second vibrating diaphragm 21*a*.

It should be noted that the first central portion 111 of the first vibrating diaphragm 11 and the second central portion 211 of the second vibrating diaphragm 21*a* may also have a planar structure, that is, the first central portion 111 of the first vibrating diaphragm 11 and the second central portion 211 of the second vibrating diaphragm 21*a* are an integral structure, of course, it can also have other structures, as long as the first vibrating diaphragm and the second vibrating diaphragm can be fixedly connected in the avoid hole, which is not limited in the present disclosure.

Further, referring to FIGS. 3 to 5 and 12 to 20, the magnetic circuit system 3*a* includes a magnetic yoke 34*a* and a central magnetic circuit portion and a side magnetic circuit portion (none of them are marked) provided on the magnetic yoke 34*a;* a magnetic gap 31 for accommodating the voice coil 12 is defined between the central magnetic circuit portion and the side magnetic circuit portion; at least one of the central magnetic circuit portion and the side magnetic circuit portion is provided with a permanent magnet; and a middle portion of the magnetic yoke 34*a* is cooperated with the central magnetic circuit portion to define the avoid hole 32*a*.

In this embodiment, the central magnetic circuit portion may include the central magnetic steel 35*a* or the side wall of the magnetic yoke 34*a*, and the side magnetic circuit portion may be the side magnetic steel 37 or the side wall of the magnetic yoke 34*a*. At least one of the central magnetic circuit portion and the side magnetic circuit portion is provided with a permanent magnet, which can ensure the magnetic stability of the magnetic circuit portion, thereby providing a relatively stable magnetic field, so that the vibration of the first vibrating diaphragm 11 is relatively stable, so that the stability of the sound generation of the sounding device 210 is ensured. Since the amplitude of the central portion of the first vibrating diaphragm 11 corresponding to the central magnetic circuit portion is usually the largest, the central portion of the first vibrating diaphragm 11 and the central portion of the second vibrating diaphragm 21*a* are fixedly connected through the avoid hole 32*a*, so that it is more labor-saving when the first vibrating diaphragm 11 pushes the second vibrating diaphragm 21*a*.

In the first embodiment of the magnetic circuit system 3*a*, the central magnetic circuit portion of the magnetic circuit system 3*a* includes a central magnetic steel 35*a* arranged in the middle portion of the magnetic yoke 34*a* and a central magnetic conductive plate 36 arranged on a top of the central magnetic steel 35*a*, the magnetic yoke 34*a* defines a first hole 341, the central magnetic steel 35*a* defines a second hole 351*a*, the central magnetic conductive plate 36 defines a third hole 361, and the first hole 341, the second hole 351*a* and the third hole 361 are communicated to define the avoid hole 32*a*.

In this embodiment, the central position of the magnetic circuit system 3*a* is sequentially provided with a magnetic yoke 34*a*, a central magnetic steel 35*a* and a central magnetic conductive plate 36 from bottom to top. The magnetic yoke 34*a* defines a first hole 341, the central magnetic steel 35*a* defines a second hole 351*a*, and the magnetic conductive plate 36 defines a third hole 361. The first hole 341, the second hole 351*a* and the third hole 361 are communicated to define a central avoid hole 32*a*, that is, the avoid hole 32*a* directly penetrates the magnetic yoke 34*a*, the central magnetic steel 35*a*, and the magnetic conductive plate 36. The first central portion and the second central portion are fixedly connected in the avoid hole 32*a* to realize the linkage between the first vibrating diaphragm 11 and the second vibrating diaphragm 21*a*. The linkage is simple in form, which facilitates the air circulation between the first acoustic cavity 5 and the second acoustic cavity 6.

Figure 12:
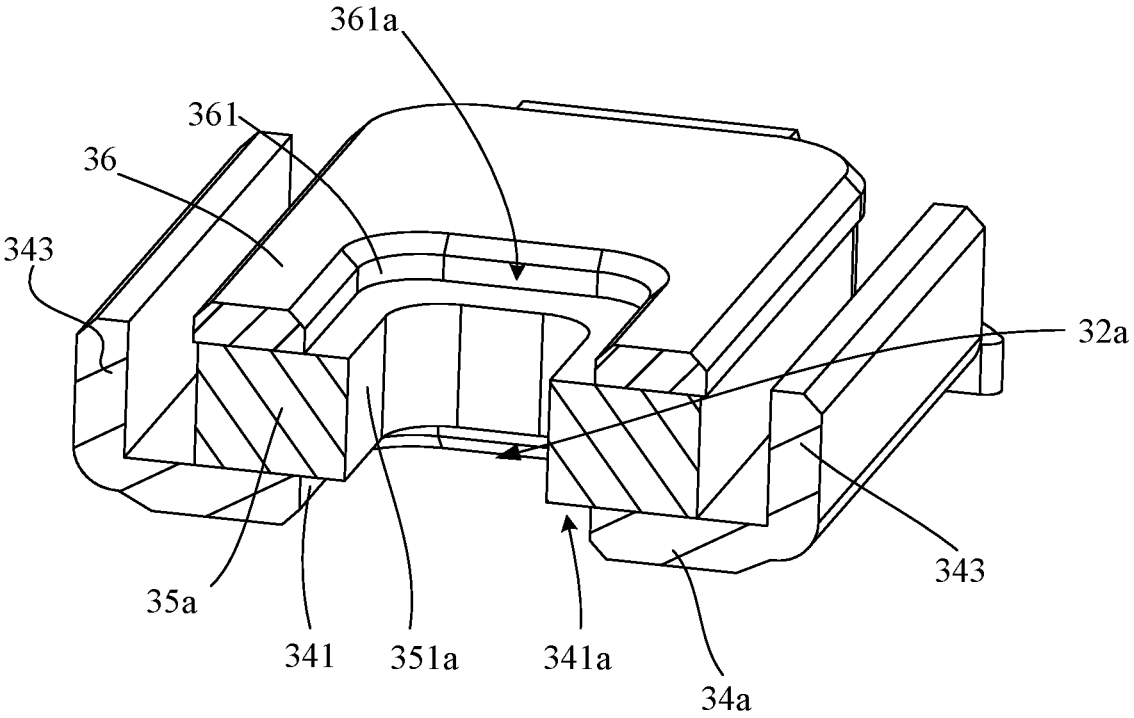
FIG. 12 is a cross-sectional view of the magnetic circuit system shown in FIG. 11.
Figure 13:
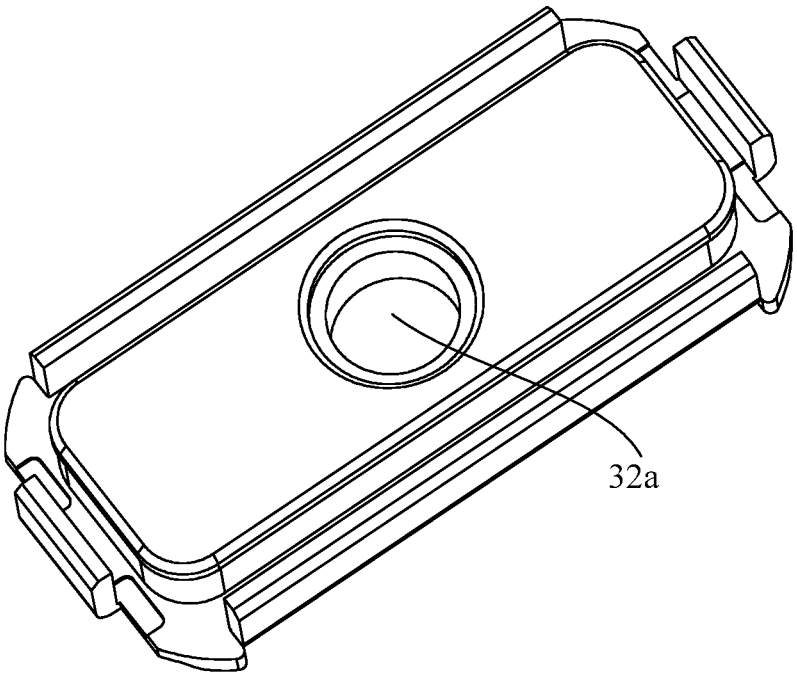
FIG. 13 is a schematic structural diagram of the magnetic circuit system of the sounding device in FIG. 3 according to another embodiment.
Figure 14:
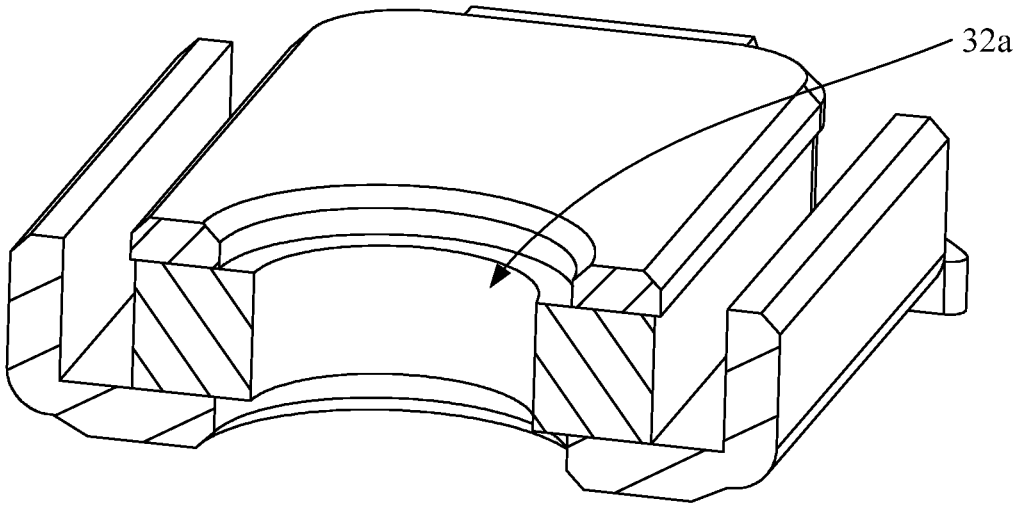
FIG. 14 is a cross-sectional view of the magnetic circuit system shown in FIG. 13.
Figure 21:
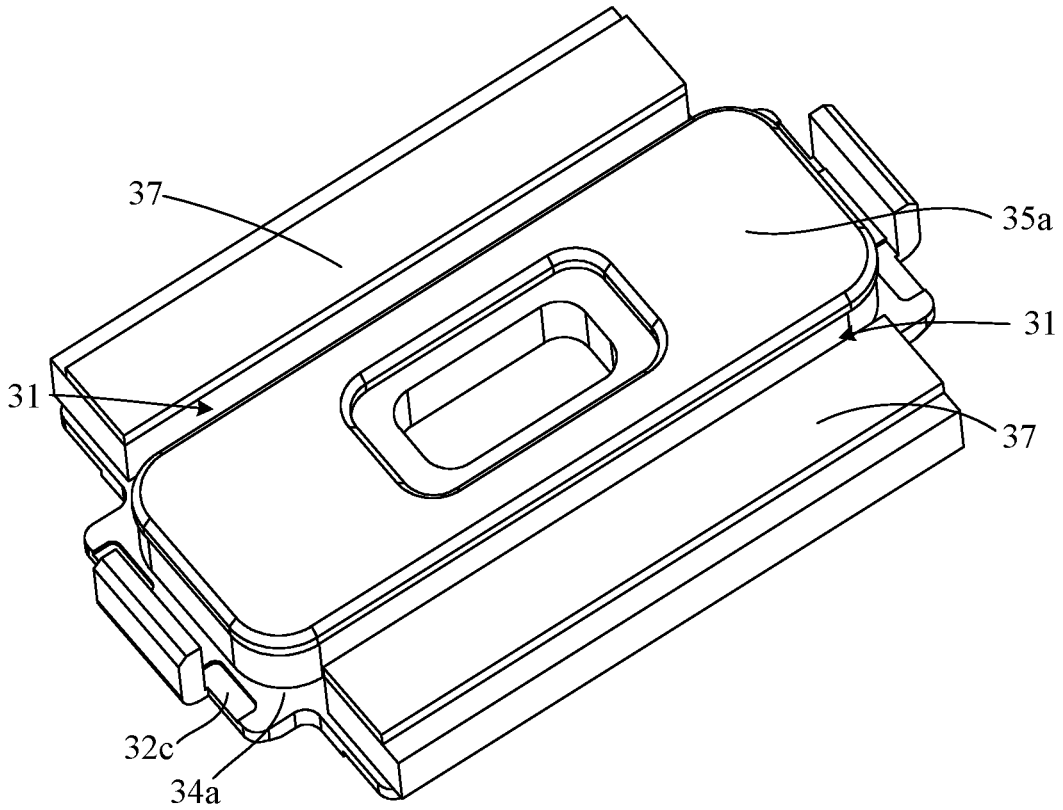
FIG. 21 is a schematic structural diagram of a second vibrating diaphragm in the sounding device shown in FIG. 1 according to an embodiment.

Referring to FIG. 12, in an embodiment of the side magnetic circuit portion, the side magnetic circuit portion includes a baffle 343 formed by bending from the periphery of the magnetic yoke 34*a*, and a magnetic gap 31 is defined between the central magnetic steel 35*a* and the baffle 343. Referring to FIG. 21, of course, in another embodiment of the side magnetic circuit portion, when the side magnetic circuit portion includes a plurality of side magnetic steels 37 arranged on the periphery of the central magnetic steel 35*a*, the magnetic gap 31 is defined between the central magnetic steel 35*a* and the side magnetic steels 37, and the magnetic circuit system 3*a* can be provided with two side magnetic steels 37 or four side magnetic steels 37.

Figure 22:
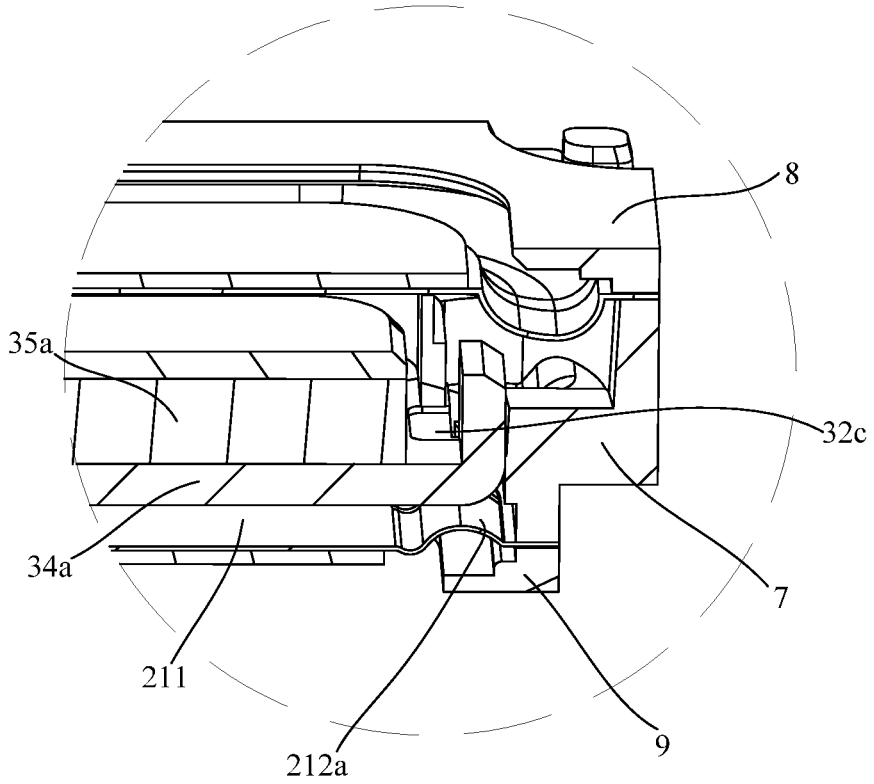
FIG. 22 is a schematic structural diagram of the second vibrating diaphragm in the sounding device shown in FIG. 1 according to another embodiment.

Please refer to FIG. 22. Of course, the magnetic circuit system 3*a* further defines a side through hole 32*c* at the position of the magnetic gap 31. In this embodiment, by defining the side through hole 32*c*, in combination with the air flow passage 33, the connectivity between the first acoustic cavity 5 and the second acoustic cavity 6 is further increased, so that when the first vibrating diaphragm 11 vibrates, more air can flow between the first acoustic cavity 5 and the second acoustic cavity 6 within a period of time, and the air pressure between the first acoustic cavity 5 and the second acoustic cavity 6 is more balanced, so that the resulting resistance is smaller.

Further, in order to increase the flow area as much as possible, a plurality of side through holes 32*c* are provided, and the plurality of side through holes 32*c* are arranged at intervals along the circumferential direction of the magnetic gap 31. In this way, the balance of the communication can be ensured and the magnetic circuit can be evenly communicated.

Specifically, the side through holes 32*c* are defined on the magnetic yoke 34*a*. Since the magnetic yoke 34*a* is closest to the second acoustic cavity 6 compared to the central magnetic steel 35*a* and the magnetic conductive plate 36, it is also the most convenient for the side through holes 32*c* to be defined on the magnetic yoke 34*a*.

The preferred form of the central magnetic steel is described as follows.

Figure 23:
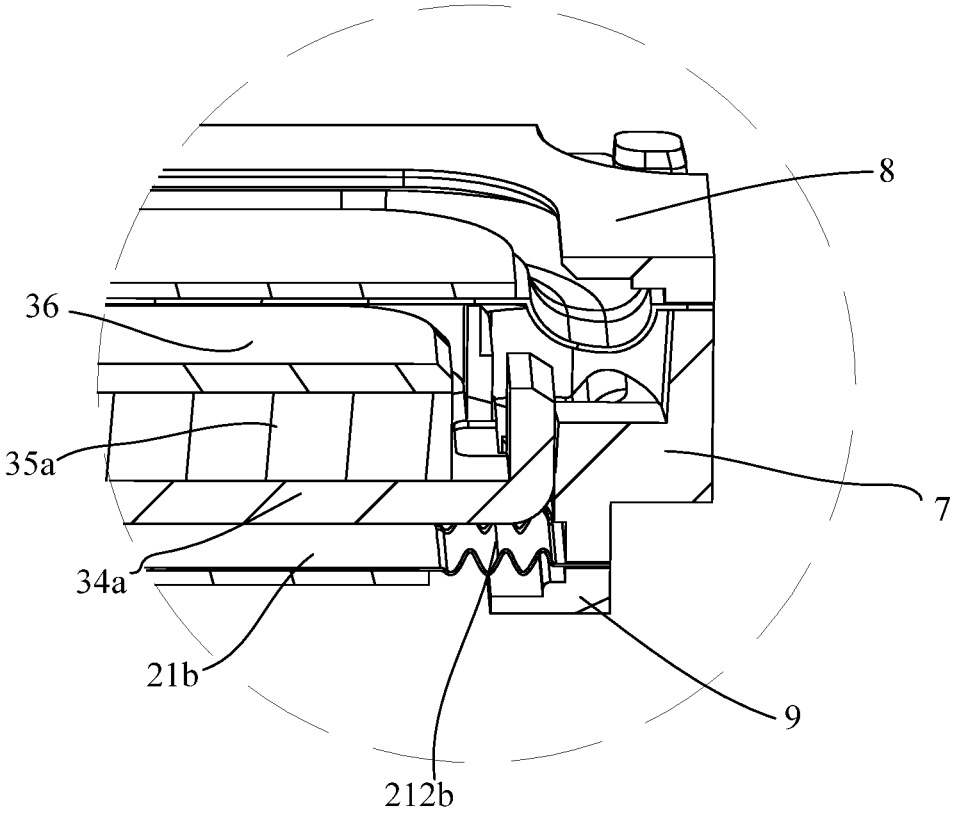
FIG. 23 is a schematic structural diagram of a central magnetic steel in the magnetic circuit system of the sounding device according to a first embodiment of the present disclosure.
Figure 24:
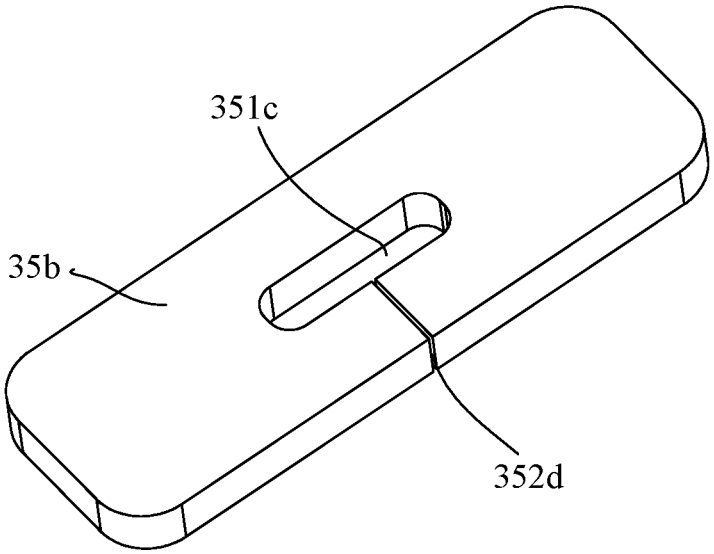
FIG. 24 is a schematic structural diagram of the central magnetic steel in the magnetic circuit system of the sounding device according to a second embodiment of the present disclosure.
Figure 25:
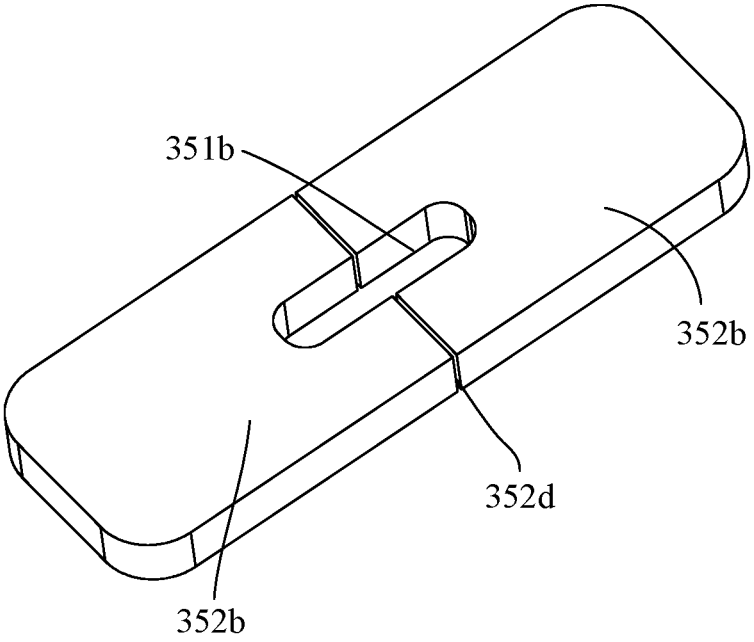
FIG. 25 is a schematic structural diagram of the central magnetic steel in the magnetic circuit system of the sounding device according to a third embodiment of the present disclosure.
Figure 26:
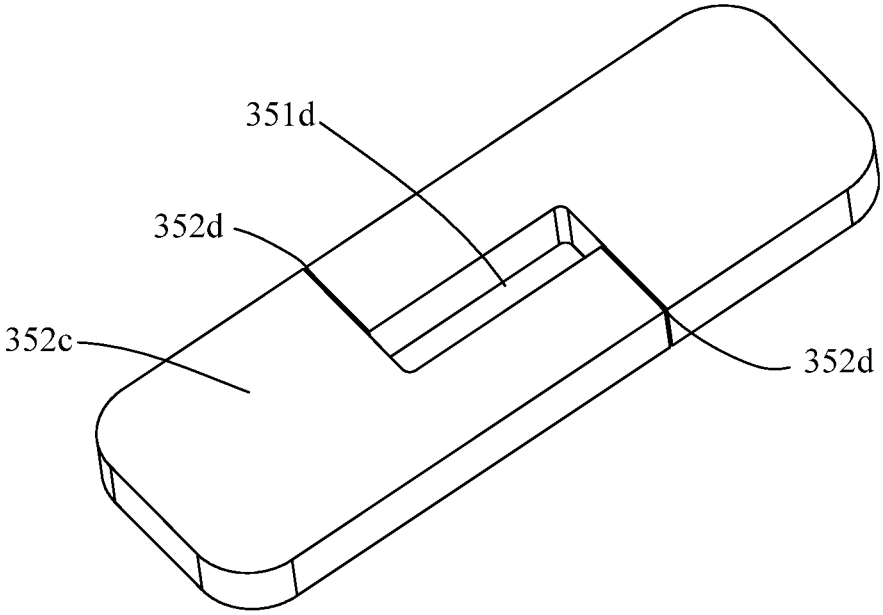
FIG. 26 is a schematic structural diagram of the central magnetic steel in the magnetic circuit system of the sounding device according to a fourth embodiment of the present disclosure.
Figure 27:
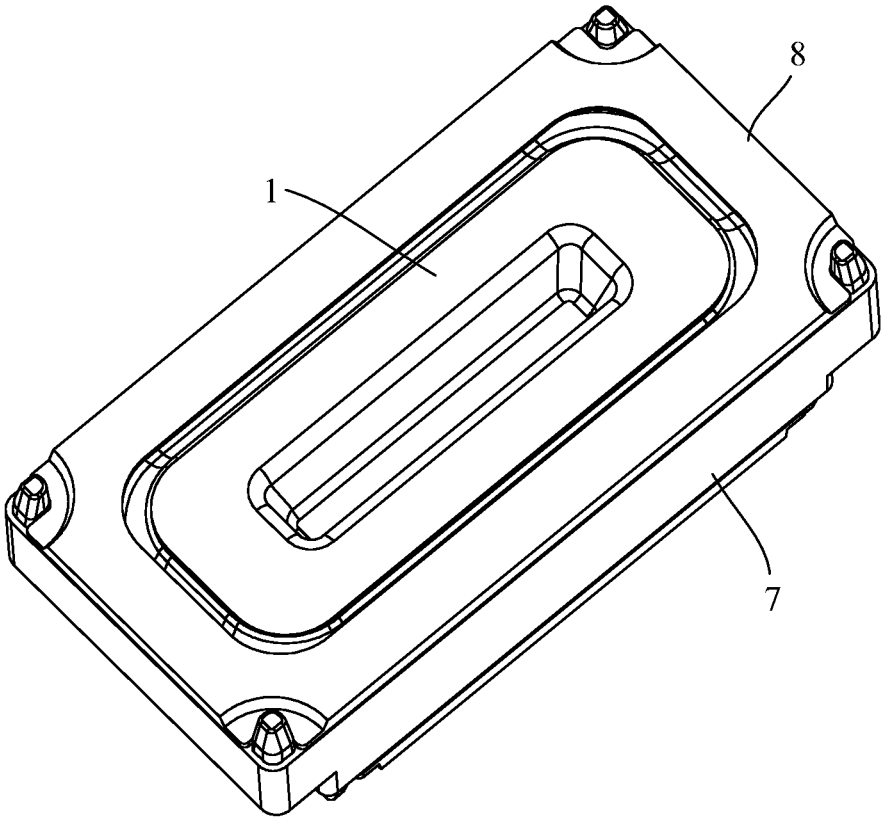
FIG. 27 is a schematic diagram of a front structure of a sounding device according to another embodiment of the present disclosure.
Figure 28:
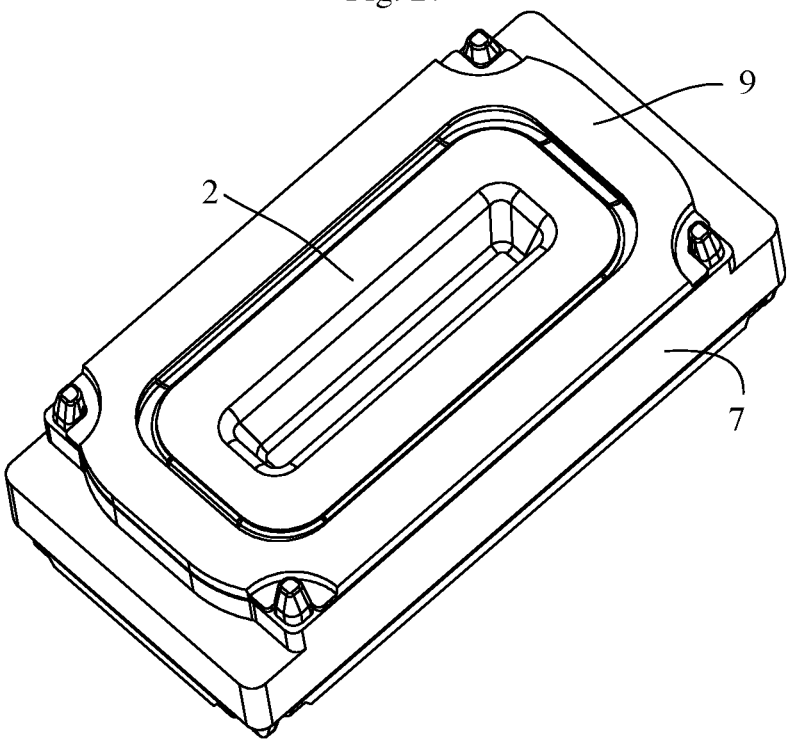
FIG. 28 is a schematic diagram of a back structure of the sounding device according to another embodiment of the present disclosure.
Figure 29:
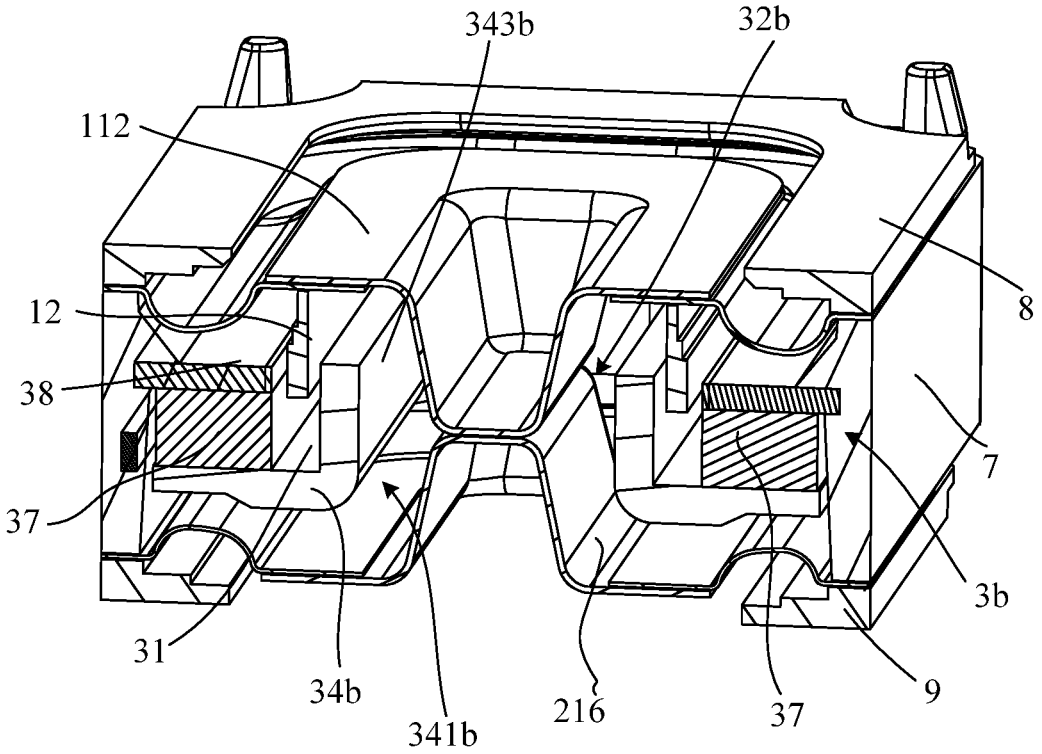
FIG. 29 is a cross-sectional view of the sounding device shown in FIG. 27.
Figure 30:
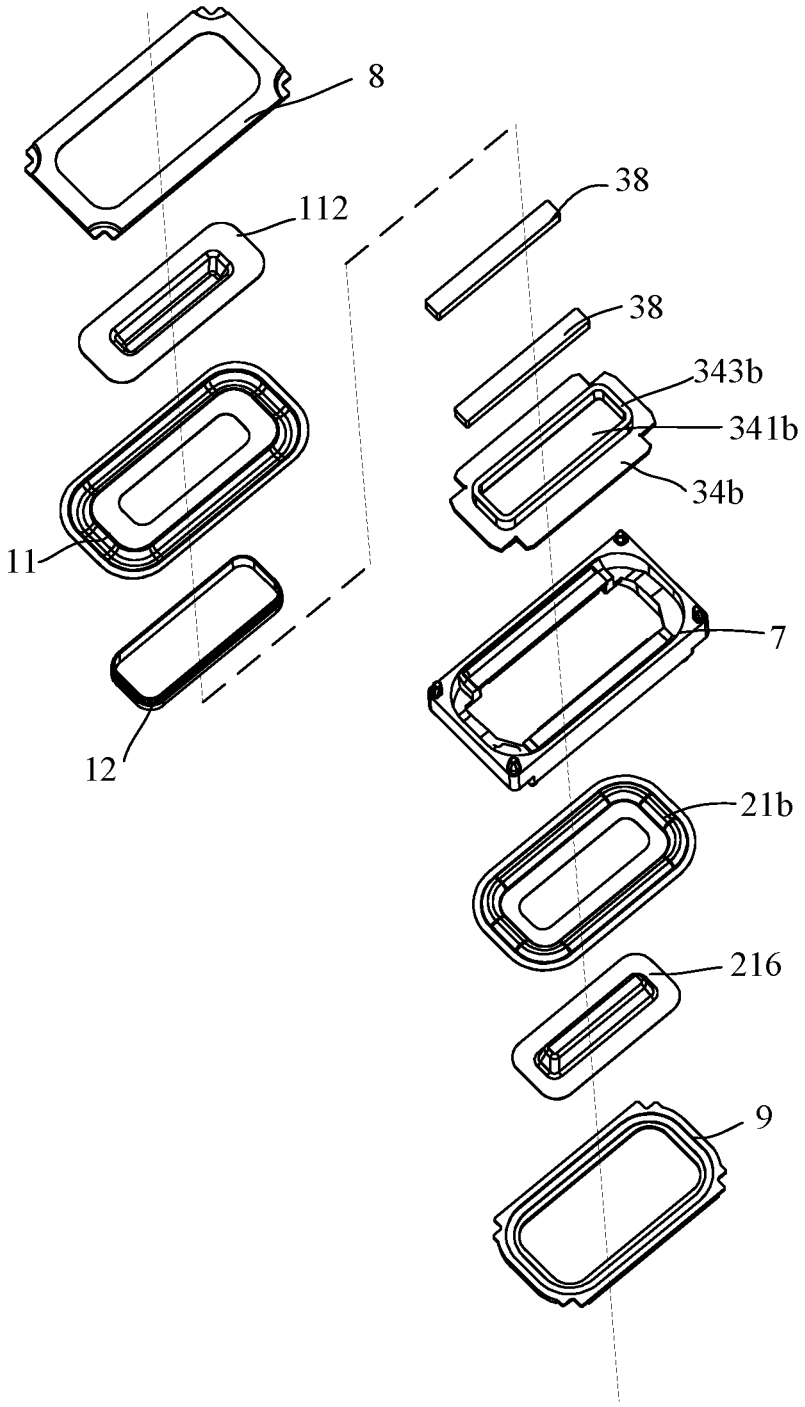
FIG. 30 is an exploded view of the sounding device shown in FIG. 27.
Figure 31:
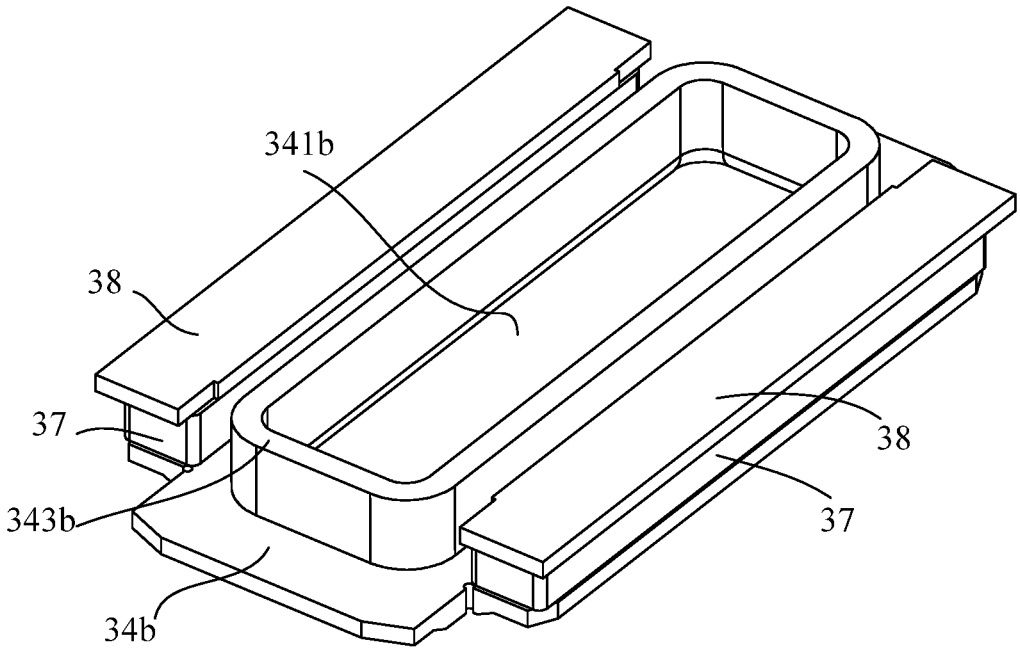
FIG. 31 is a schematic structural diagram of the magnetic circuit system in the sounding device shown in FIG. 27 according to a first embodiment.
Figure 32:
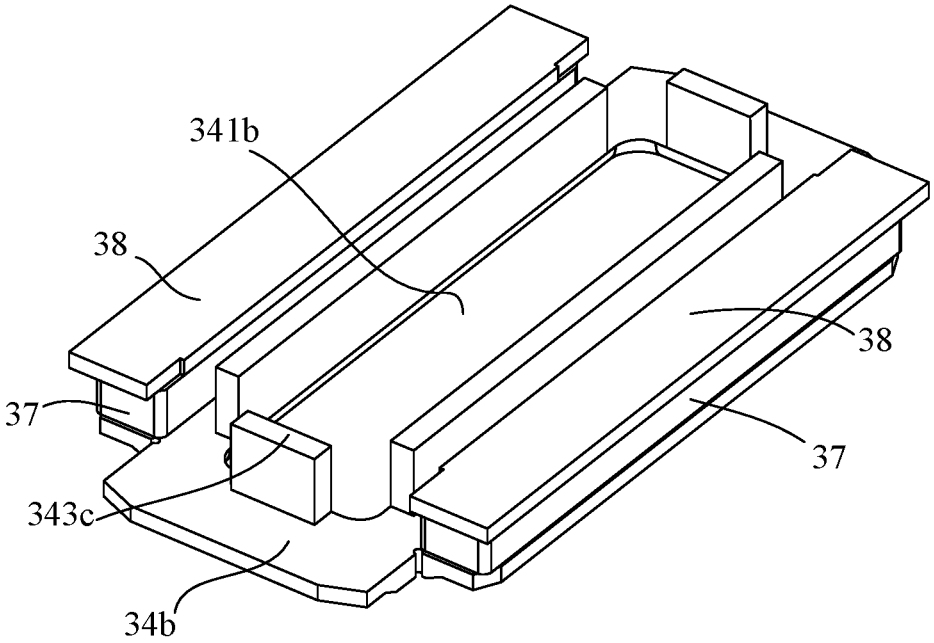
FIG. 32 is a schematic structural diagram of the magnetic circuit system in the sounding device shown in FIG. 27 according to a second embodiment.
Figure 33:
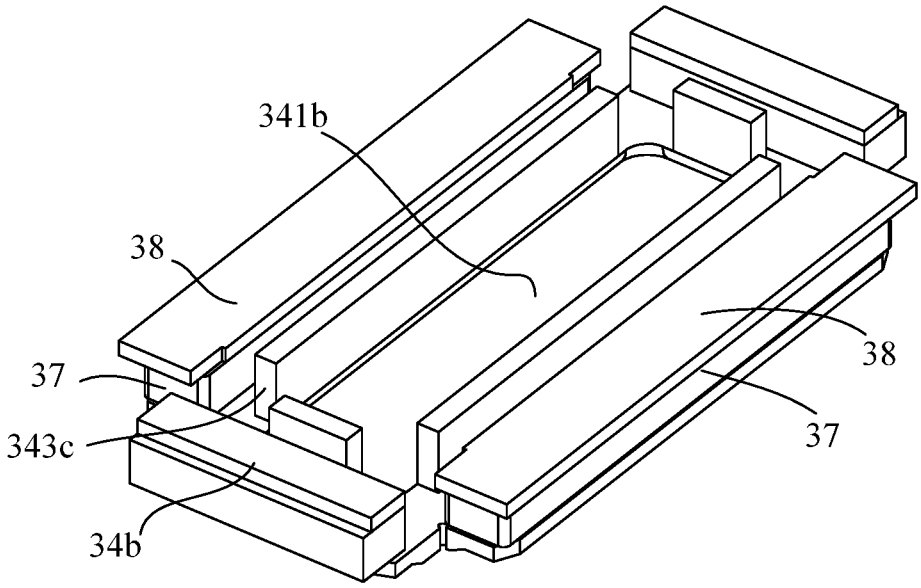
FIG. 33 is a schematic structural diagram of the magnetic circuit system in the sounding device shown in FIG. 27 according to a third embodiment.
Figure 34:
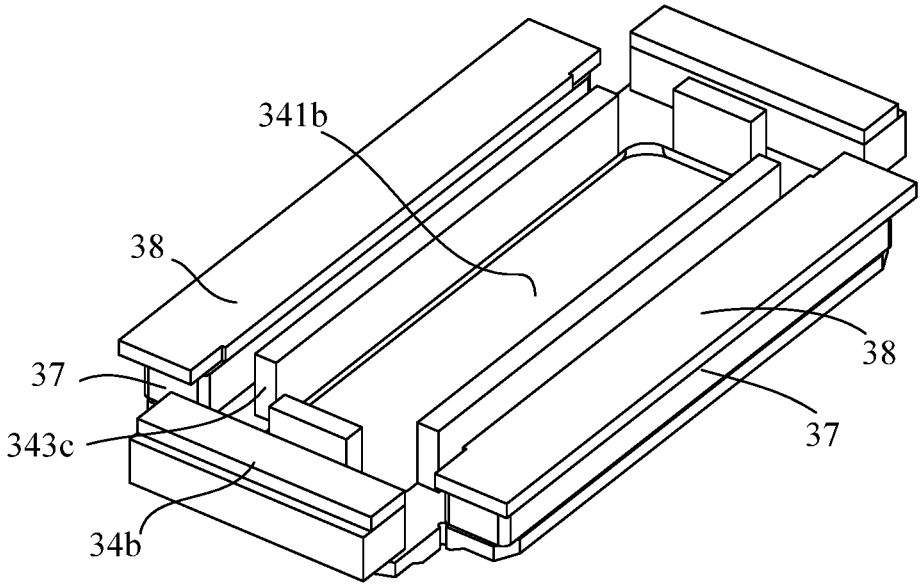
FIG. 34 is a schematic structural diagram of the magnetic circuit system in the sounding device shown in FIG. 27 according to a fourth embodiment.

Preferably, referring to FIGS. 23 and 25, the central magnetic steel 35*b* is composed of a piece of magnetic steel, and the central magnetic steel 35*b* defines a slit 352*d* communicating an inner wall surface of the second hole 351*c* and a peripheral surface of the central magnetic steel 35*b*. By setting the slit 352*d*, the second hole 351*c* can be conveniently processed by a wire cutting process. Specifically, the slit 352*d* can be processed first, and then the second hole 351*c* can be processed, compared to directly drilling the second hole 351*c*, it is more practical. In this way, the processing difficulty can be reduced and the processing cost can be reduced.

The central magnetic steel may also include two sub-magnetic steels (352*b*, 352*c*) spliced together, and the slits 352*d* of the two sub-magnetic steels (352*b*, 352*c*) are communicated to the second hole (351*b*, 351*d*). In this way, the second hole (351*b*, 351*d*) is defined by splicing the two sub-magnetic steels (352*b*, 352*c*), and the inner wall surface of the second hole (351*b*, 351*d*) is actually transformed into the outer circumferential surfaces of the sub-magnetic steels (352*b*, 352*c*), that is, the open groove wall surfaces on the outer circumferential surface of the sub-magnetic steels (352*b*, 352*c*), which can facilitate the processing of the second hole (351*b*, 351*d*). Further, in order to facilitate the assembly and improve the interchangeability of the raw materials of the two sub-magnetic steels (352*b*, 352*c*), the two sub-magnetic steels (352*b*, 352*c*) are symmetrical about a vertical plane passing through a center of the second hole (351*b*, 351*d*), or are symmetrical about a center of the second hole (351*b*, 351*d*). Specifically, during assembly, unmagnetized blanks of the two sub-magnetic steels (352*b*, 352*c*) can be spliced first, and then magnetized. The blanks of the two sub-magnetic steels (352*b*, 352*c*) can be interchanged, so only a blank of one shape and size needs to be provided.

Please refer to FIG. 5 again, the first vibrating diaphragm 11, the second vibrating diaphragm (21*a*, 21*b*) and the central magnetic steel (35*a*, 35*b*) are all elongated, and long axes of the first vibrating diaphragm 11, the second vibrating diaphragm (21*a*, 21*b*), and the central magnetic steel (35*a*, 35*b*) are located in a same vertical plane, and the avoid hole 32*a* extends along a length of the central magnetic steel (35*a*, 35*b*). It can be understood that the vertical plane is a plane parallel to the up and down direction, and accordingly the shape of the sounding device 210 is also elongated. This structure has a higher space utilization rate when applied to the portable terminal 100. At the same time, under the premise of the same area, the elongated first vibrating diaphragm 11 and the second vibrating diaphragm (21*a*, 21*b*) are easier to obtain larger amplitude, and for the first vibrating diaphragm 11, it is easier to drive the second vibrating diaphragm (21*a*, 21*b*). The cross sections of the first protrusion (113*a*, 113*b*, 113*c*, 113*d*, 113*e*) and the second protrusion (214*a*, 214*b*, 214*c*, 214*d*, 214*e*) are elongated, and long axes of the cross sections of the two and a long axis of the avoid hole 32*a* are located in a same vertical plane, and the connection area of the first vibrating diaphragm 11 and the second vibrating diaphragm (21*a*, 21*b*) will also increase.

Referring to FIG. 12, an inner wall surface of the first hole 341 and a top surface of the central magnetic steel 35*a* are enclosed to define a first stepped recess 351*a*; and/or an inner wall surface of the third hole 361 and a bottom surface of the central magnetic steel 35*a* are enclosed to define a second stepped recess 361*a*.

In this embodiment, in order to increase the structural strength of the first vibrating diaphragm 11 and the second vibrating diaphragm 21*a*, the longitudinal cross-sectional shape of the sidewalls of the first protrusion 113*a* and the second protrusion 214*a* may be stepped. The first protrusion 113*a* and the second protrusion 214*a* are arranged in mirror symmetry with the cross section of the central magnetic steel 35*a*. In order to better accommodate the first protrusion 113*a* and the second protrusion 214*a*, correspondingly, the inner wall surface of the first hole 341 and the top surface of the central magnetic steel 35*a* are enclosed to define a first stepped recess 351*a*, and the inner wall surface of the third hole 361 and the bottom surface of the central magnetic steel 35*a* are enclosed to define a second stepped recess 361*a*, which makes the space between the side wall of the first protrusion 113*a* and the inner wall surface of the avoid hole larger, and provides larger space for the linkage of the first protrusion 113*a* and the second protrusion 214*a*, thereby providing more circulation space, making the air pressure between the first acoustic cavity 5 and the second acoustic cavity 6 be more balanced, and further reducing the resulting resistance.

In addition, a section of stepped side walls of the first protrusion 113*a* and the second protrusion 214*a* away from the central magnetic steel is set as a first step, and a height of the first step does not exceed a thickness of the central magnetic conductive plate 36 and a thickness of the magnetic yoke 34*a*. Thus, the first protrusion 113*a* and the second protrusion 214*a* may have more free space for vibration and sound.

Please refer to FIGS. 27 to 30. In the second embodiment of the magnetic circuit system 3*b*, the magnetic yoke 34*b* defines an opening 341*b* in the middle portion, an edge of the opening 341*b* is bent and extended toward the first vibrating diaphragm 11 to form a flanging 343*b*, the central magnetic circuit portion is formed by the flanging 343*b*, and the flanging 343*b* is enclosed to define the avoid hole 32*b*; and the side magnetic circuit portion includes side magnetic steels 37 arranged at a periphery of the flanging 343*b*, and a side magnetic conductive plate 38 arranged at top of the side magnetic steels 37.

In this embodiment, an opening 341*b* is defined in the middle portion of the magnetic yoke 34*b*, and the edge of the opening 341*b* is bent and extended in the direction of the first vibrating diaphragm 11 to form a flanging 343*b*. The cross-sectional shape of the flanging 343*b* is rectangular, which is matched with the shape of the first protrusion 113*a* and the second protrusion 214*a*, and is configured to accommodate the first protrusion 113*a* and the second protrusion 214*a*. At the same time, the flanging 343*b* also forms the central magnetic circuit portion, and defines the magnetic gap 31 between the side magnetic steels 37 on the periphery of the flanging 343*b*. The structure is simple and easy to process and implement. While defining the avoid hole 32*b*, the magnetic gap 31 is also defined, so as to further reduce the weight of the sounding device 210.

Please refer to FIGS. 31 to 34. The flanging 343*b* structure here may be a ring-shaped structure continuously arranged along the periphery of the opening 341*b*, or a plurality of flangings 343*c* arranged along the edge of the opening 341*b*, so as to further increase the air circulation space, and improve the sound effect.

There can be two to four side magnetic steels 37 forming the side magnetic circuit portion. Correspondingly, the side magnetic conductive plates 38 on the top of the side magnetic steels 37 can be provided with two to four; or when four side magnetic steels 37 are provided, the side magnetic conductive plate 38 in a ring-shaped structure covers the tops of the four side magnetic steels 37, which can facilitate batch processing.

Further, referring to FIG. 3, FIG. 22, and FIG. 23, the first vibrating diaphragm 11 further includes a first folding ring portion 115 arranged around the first flat portion 111*a* and a first fixing portion 117 arranged around the first folding ring portion 115; the second vibrating diaphragm (21*a*, 21*b*) includes a second folding ring portion (212*a*, 212*b*) arranged around the second flat portion 211*a* and a second fixing portion 213 arranged around the second folding ring portion (212*a*, 212*b*). The first folding ring portion 115 and/or the second folding ring portion (212*a*, 212*b*) is a structure formed by a protrusion, or, the first folding ring portion 115 and/or the second folding ring portion (212*a*, 212*b*) is a wave-shaped structure formed by at least one protrusion and at least one recess.

In this embodiment, the first flat portion 111*a* and the second flat portion 211*a* are both provided as flat sheet structures, so that the first vibrating diaphragm 11 and the second vibrating diaphragm (21*a*, 21*b*) occupy less space in the up and down direction, and a sufficiently large amplitude can be generated. In this way, the sounding device 21 provided by the present disclosure has a thin structure in the up and down direction as a whole, and is easier to be applied in a flat installation space. The first folding ring portion 115 and the second folding ring portion (212*a*, 212*b*) provide a certain degree of compliance for the movement of the first flat portion 111*a* and the second flat portion 211*a*, that is, provide a certain degree of flexibility, so that the first flat portion 111*a* and the second flat portion 211*a* are easier to be pushed by the airflow flowing through the avoid hole (32*a*, 32*b*) and the side through hole 32*c*.

Figure 35:
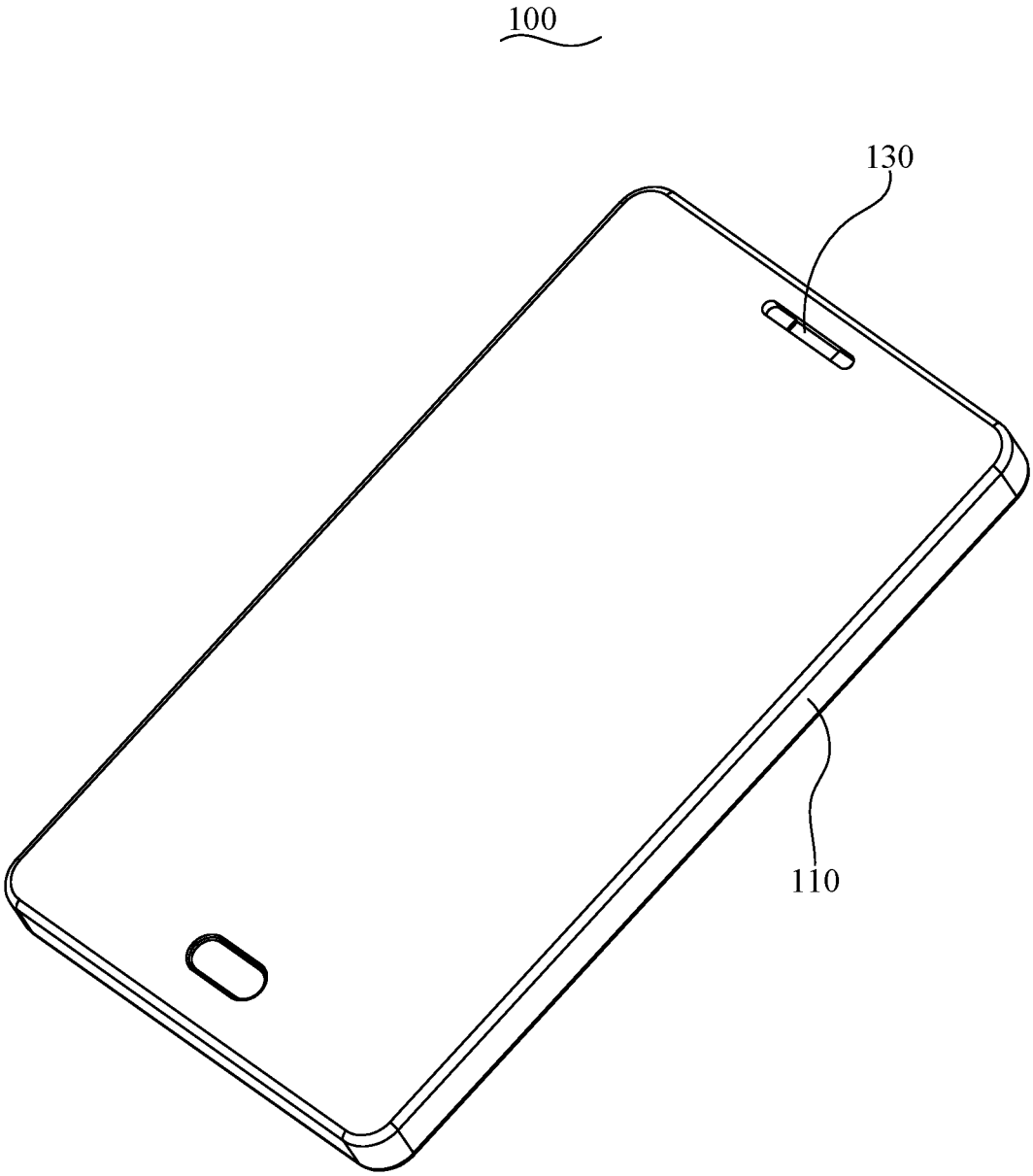
FIG. 35 is a schematic diagram of a front structure of a portable terminal according to an embodiment of the present disclosure.
Figure 36:
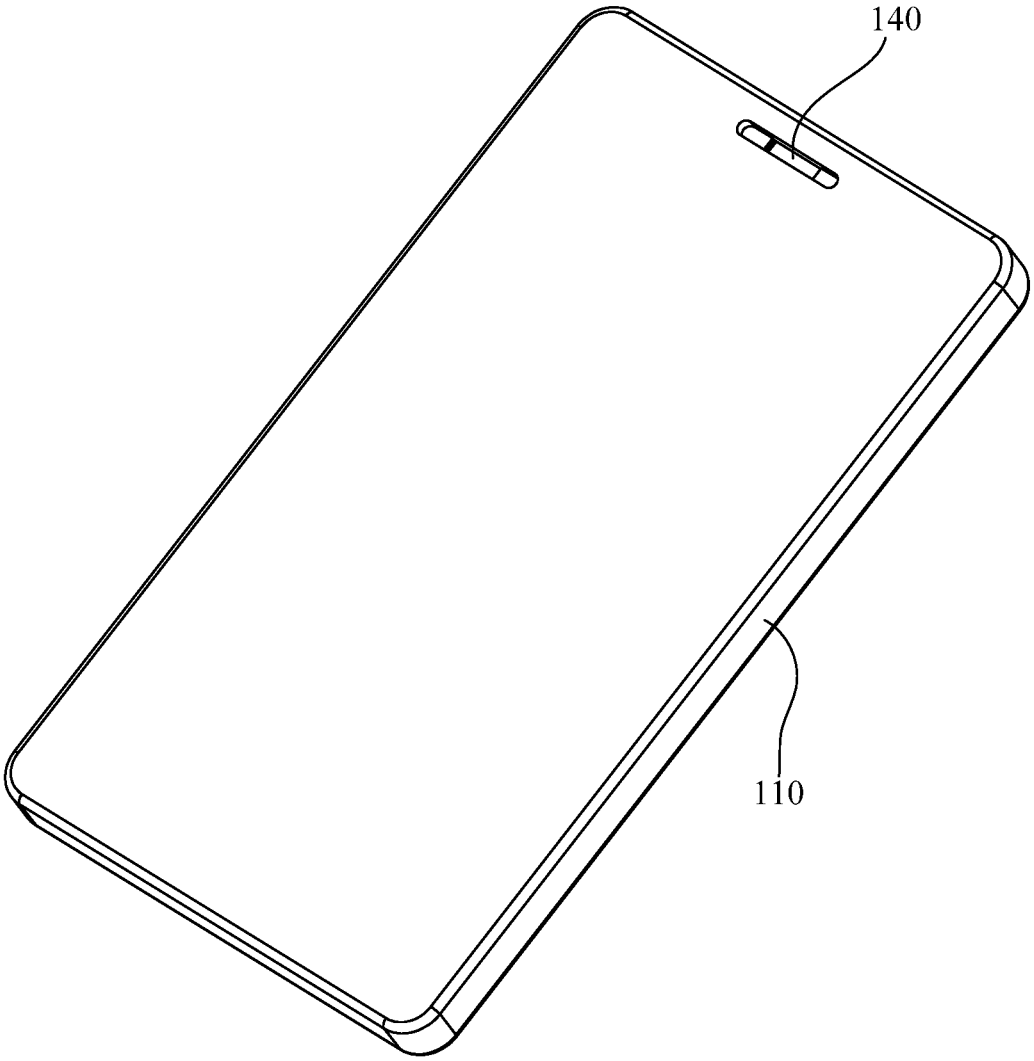
FIG. 36 is a schematic diagram of a back structure of the portable terminal in FIG. 35.

Please refer to FIGS. 35 to 36. The present disclosure further provides a portable terminal 100, which includes a housing 110 with an accommodating cavity inside the housing 110. The portable terminal 100 further includes a sounding device 210. Specific structure of the sounding device 210 may refer to the foregoing embodiments. Since the portable terminal 100 adopts all the technical solutions of all the above embodiments, it at least has all the beneficial effects brought by the technical solutions of the foregoing embodiments, which are not described in detail here again. The sounding device 210 is installed in the accommodating cavity, and the housing 110 defines a first acoustic hole 130 corresponding to the first vibrating diaphragm 11, and a second acoustic hole 140 corresponding to the second vibrating diaphragm (21*a*, 21*b*). Preferably, in order to shorten the propagation path of sound inside the housing 110 and reduce the acoustic resistance, the first acoustic hole 130 is defined in the housing 110 at a position directly opposite to the first vibrating diaphragm 11, and the second acoustic hole 140 is defined in the housing 110 at a position directly opposite to the second vibrating diaphragm (21*a*, 21*b*).

Further, the housing 110 includes a front and a back arranged oppositely, the first acoustic hole 130 is defined on the front, and the second acoustic hole 140 is defined on the back.

The above is only preferable embodiments of this disclosure, and thus does not limit the scope of this disclosure, and the equivalent structural transformation made by the content of the specification and the drawings of this disclosure, or directly/indirectly applied to other related technical fields are all included in the patent protection scope of this disclosure.

What is claimed is:

1. A sounding device, comprising a first vibrating system, a second vibrating system and a magnetic circuit system, wherein:

the first vibrating system comprises a first vibrating diaphragm and a voice coil arranged inside the first vibrating diaphragm, and the first vibrating diaphragm comprises a first central portion;

the second vibrating system comprises a second vibrating diaphragm disposed opposite to the first vibrating diaphragm, and the second vibrating diaphragm comprises a second central portion;

the magnetic circuit system is arranged between the first vibrating diaphragm and the second vibrating diaphragm, and the voice coil is accommodated in a magnetic gap of the magnetic circuit system; the magnetic circuit system defines an avoid hole; and at least one of the first central portion and the second central portion is extended into the avoid hole to fixedly connect the first central portion and the second central portion;

the magnetic circuit system comprises a magnetic yoke and a central magnetic circuit portion and a side magnetic circuit portion provided on the magnetic yoke; and the magnetic gap for accommodating the voice coil is defined between the central magnetic circuit portion and the side magnetic circuit portion;

at least one of the central magnetic circuit portion and the side magnetic circuit portion is provided with a permanent magnet; and a middle portion of the magnetic yoke is cooperated with the central magnetic circuit portion to define the avoid hole; and the magnetic yoke defines an opening in the middle portion, an edge of the opening is bent and extended toward the first vibrating diaphragm to form a flanging, the central magnetic circuit portion is formed by the flanging, and the flanging is enclosed to define the avoid hole; and the side magnetic circuit portion comprises side magnetic steels arranged at a periphery of the flanging, and a side magnetic conductive plate arranged at top of the side magnetic steels.

2. The sounding device of claim 1, wherein the first central portion comprises: a first flat portion and a first reinforcing portion combined with the first flat portion;

the second central portion comprises: a second flat portion and a second reinforcing portion combined with the second flat portion; and wherein at least one of the first central portion and the second central portion is extended into the avoid hole to fixedly connect the first central portion and the second central portion comprises:

at least one of the first reinforcing portion and the second reinforcing portion is extended into the avoid hole to fixedly connect the first reinforcing portion and the second reinforcing portion.

3. The sounding device of claim 1, wherein a first acoustic cavity is defined between the magnetic circuit system and the first vibrating diaphragm, a second acoustic cavity is defined between the magnetic circuit system and the second vibrating diaphragm, and the avoid hole is communicated with the first acoustic cavity and the second acoustic cavity.

4. The sounding device of claim 2, wherein the first reinforcing portion comprises a first protrusion extending into the avoid hole, the second reinforcing portion comprises a second protrusion extending into the avoid hole, and the first protrusion and the second protrusion are fixedly connected in the avoid hole.

5. The sounding device of claim 4, wherein the first protrusion and the second protrusion are fixedly connected in surface contact.

6. The sounding device of claim 4, wherein the first protrusion and the second protrusion are arranged to be tapered toward each other.

7. The sounding device of claim 6, wherein a longitudinal cross-sectional shape of a side wall of the first protrusion and/or the second protrusion is stepped, arced or linear.

8. The sounding device of claim 6, wherein a cross-sectional shape of the first protrusion and/or the second protrusion is rectangular or circular.

9. The sounding device of claim 1, wherein the central magnetic circuit portion comprises a central magnetic steel arranged in the middle portion of the magnetic yoke and a central magnetic conductive plate arranged on a top of the central magnetic steel, the magnetic yoke defines a first hole, the central magnetic steel defines a second hole, the central magnetic conductive plate defines a third hole, and the first hole, the second hole and the third hole are communicated to define the avoid hole.

10. The sounding device of claim 9, wherein an inner wall surface of the first hole and a top surface of the central magnetic steel are enclosed to define a first stepped recess; and/or an inner wall surface of the third hole and a bottom surface of the central magnetic steel are enclosed to define a second stepped recess.

11. The sounding device of claim 1, wherein the side magnetic circuit portion comprises a baffle formed by bending from a periphery of the magnetic yoke; or, the side magnetic circuit portion comprises side magnetic steels on a periphery of the central magnetic steel.

12. The sounding device of claim 1, wherein a plurality of flangings are provided, and the plurality of flangings are arranged at intervals along the edge of the opening.

13. The sounding device of claim 1, wherein, the first vibrating diaphragm further comprises a first folding ring portion arranged around the first central portion, and a first fixing portion arranged around the first folding ring portion;

the second vibrating diaphragm further comprises a second folding ring portion arranged around the second central portion, and a second fixing portion arranged around the second folding ring portion; and the first central portion and the second central portion are both flat sheet structures, and the first folding ring portion and/or the second folding ring portion is a structure formed by a protrusion, or, the first folding ring portion and/or the second folding ring portion is a wave-shaped structure formed by at least one protrusion and at least one recess.

14. A portable terminal, comprising a housing defining an accommodating cavity inside, wherein the portable terminal further comprises the sounding device as recited in claim 1, the sounding device is installed in the accommodating cavity, and the housing defines a first sound hole corresponding to the first vibrating diaphragm and a second sound hole corresponding to the second vibrating diaphragm.

15. The portable terminal of claim 14, wherein the housing comprises a front and a back arranged oppositely, the first acoustic hole is defined on the front, and the second acoustic hole is defined on the back.

* * * * *